US010322856B2

(12) United States Patent
Giraud et al.

(10) Patent No.: US 10,322,856 B2
(45) Date of Patent: Jun. 18, 2019

(54) CONTAINER HAVING A CHILD RESISTANT CLOSURE WITH A SMALL PROFILE

(71) Applicant: CSP Technologies, Inc., Auburn, AL (US)

(72) Inventors: Jean-Pierre Giraud, Auburn, AL (US); Herve Pichot, Chennevieres-sur-Marne (FR)

(73) Assignee: CSP Technologies, Inc., Auburn, AL (US)

( * ) Notice: Subject to any disclaimer, the term of this patent is extended or adjusted under 35 U.S.C. 154(b) by 374 days.

(21) Appl. No.: 15/361,564

(22) Filed: Nov. 28, 2016

(65) Prior Publication Data

US 2017/0073130 A1 Mar. 16, 2017

Related U.S. Application Data

(63) Continuation-in-part of application No. 14/294,330, filed on Jun. 3, 2014, now Pat. No. 9,533,803.

(60) Provisional application No. 61/951,313, filed on Mar. 11, 2014, provisional application No. 61/838,385, filed on Jun. 24, 2013, provisional application No. 61/830,697, filed on Jun. 4, 2013.

(51) Int. Cl.

| | |
|---|---|
| ***B65D 50/00*** | (2006.01) |
| ***B65D 50/06*** | (2006.01) |
| ***B65D 43/16*** | (2006.01) |

(52) U.S. Cl.

CPC ..... *B65D 50/066* (2013.01); *B65D 43/16* (2013.01); *B65D 43/162* (2013.01); *B65D 2215/04* (2013.01); *B65D 2543/0062* (2013.01); *B65D 2543/0074* (2013.01); *B65D 2543/0087* (2013.01); *B65D 2543/00148* (2013.01); *B65D 2543/00296* (2013.01); *B65D 2543/00518* (2013.01); *B65D 2543/00694* (2013.01); *B65D 2543/00796* (2013.01)

(58) Field of Classification Search

CPC ..... B65D 50/00; B65D 50/06; B65D 50/046; B65D 50/066; B65D 43/162; B65D 43/16; B65D 2215/04; B65D 2543/00148; B65D 2543/00296; B65D 2543/00518; B65D 2543/0062; B65D 2543/00694; B65D 2543/0074; B65D 2543/00796; B65D 2543/0087; E05C 19/02; E05C 19/06; E05C 19/063; E05C 19/066

USPC ..... 215/224, 201; 220/283

See application file for complete search history.

(56) References Cited

U.S. PATENT DOCUMENTS 429,795 A * 6/1890 Pusey ..... E05B 65/44 70/80
5,012,941 A * 5/1991 Abrams ..... B29C 65/665 215/250
5,031,784 A * 7/1991 Wright ..... B65D 50/045 215/211
5,270,011 A * 12/1993 Altherr ..... B01L 3/50825 215/216

(Continued)

*Primary Examiner* — Ernesto A Grano
(74) *Attorney, Agent, or Firm* — David B. Gornish; Eckert Seamans Cherin & Mellott, LLC

(57) ABSTRACT

Disclosed are methods for opening containers having child resistant closures. The methods include applying inward radial pressure on a resilient guard of a container to deflect the guard inwardly, followed by applying upward pressure to an exposed front tab of a cap of the container to open the cap.

22 Claims, 23 Drawing Sheets

(56) References Cited

U.S. PATENT DOCUMENTS 6,398,067 B1 * 6/2002 Belfance ..... B65D 43/162 215/235
6,772,902 B1 * 8/2004 White ..... B65D 43/162 215/201
7,611,024 B2 * 11/2009 Yamanaka ..... B65D 47/0814 215/237
7,861,873 B1 * 1/2011 Bragg ..... B65D 50/046 215/237
8,051,998 B1 * 11/2011 Giraud ..... B65D 43/162 215/261
8,141,731 B2 * 3/2012 Mazurkiewicz ... B65D 47/0814 215/237
8,167,156 B2 * 5/2012 Milante ..... A61J 1/03 215/209
8,235,233 B2 * 8/2012 Pehr ..... B65D 55/14 215/201
8,240,491 B2 * 8/2012 Beecroft ..... B65D 50/048 215/216
8,292,101 B1 * 10/2012 Bragg ..... B65D 47/0838 215/237
D696,078 S * 12/2013 Allen ..... D7/629
8,596,493 B2 * 12/2013 Vollers ..... B65D 47/0838 215/211
D732,684 S * 6/2015 Ooi ..... D24/224
9,056,703 B2 * 6/2015 Brown ..... B01L 3/508
2003/0102323 A1 * 6/2003 Lohn ..... B01L 3/50825 220/839
2005/0023285 A1 * 2/2005 Keung ..... B65D 47/0804 220/835
2005/0205607 A1 * 9/2005 Hierzer ..... B65D 47/0804 222/153.1
2005/0242105 A1 * 11/2005 Homann ..... B65D 43/169 220/840
2006/0043100 A1 * 3/2006 Johnson ..... B29C 45/006 220/839
2007/0170191 A1 * 7/2007 Arvidsson ..... B65D 50/06 220/813
2008/0110933 A1 * 5/2008 Goncalves ..... B65D 47/0809 222/153.05
2008/0169261 A1 * 7/2008 Druitt ..... B65D 47/0809 215/237
2014/0144867 A1 * 5/2014 Giraud ..... B65D 47/0804 215/216
2015/0048088 A1 * 2/2015 Giraud ..... B65D 83/0427 220/315

* cited by examiner

CONTAINER HAVING A CHILD RESISTANT CLOSURE WITH A SMALL PROFILE

CROSS REFERENCE TO RELATED APPLICATIONS

This application is a continuation-in-part of U.S. patent application Ser. No. 14/294,330, filed Jun. 3, 2014, which claims the benefit of U.S. Provisional Patent Application Nos. 61/830,697, filed Jun. 4, 2013; 61/838,385, filed Jun. 24, 2013 and 61/951,313, filed Mar. 11, 2014, all of which are incorporated herein as if fully set forth.

FIELD OF INVENTION

The invention pertains to a container. More specifically, the invention pertains to a container having a child resistant mechanism. Optionally, the invention also pertains to a container having a sealing system and a closure system that are independent of each other.

BACKGROUND

Moisture sensitive items such as pharmaceuticals, food items, confections, tobacco products and test strips are often provided in resealable, moisture-tight containers. Such containers typically include a container body having an interior portion and an opening, and a cap that sealably engages the container body to cover the opening. Such containers are provided with a seal and a closure mechanism, and in some cases may include a child resistant closure mechanism, such as that disclosed in WO 02/16218, which is incorporated herein by reference as if fully set forth.

The child resistant closure mechanism disclosed in WO 02/16218 includes a pliable "spacer" (as the component is named in that publication), which is synonymous with a "guard" (as the component is named herein), positioned on the outer surface of the container. When the cap is in the closed position, the spacer is under the thumb tab. In one embodiment, when the cap is in the closed position, the spacer prevents a user from contacting the underside of the thumb tab with his or her finger, effectively prohibiting the opening of the container. However, the spacer is movable inwardly in the direction of the container when a sufficient inward force is applied to it. Inward movement of the spacer permits the holder of the container to access the underside of the thumb tab so an upward force can be applied to it, thereby opening the container.

In one embodiment, the outer-most surface of the spacer disclosed in WO 02/16218 is about 6 mm to 8 mm from an outer surface of the side wall of the container body. While the child resistant functionality of such an embodiment is good, for some applications, a spacer or guard with a smaller profile is preferred. In the art, the difference of even one or two millimeters between guard profiles can make the difference between a desirable design and an undesirable design, for some applications. For example, in certain applications, a spacer or guard having an outer-most surface that is about 2 mm to 4 mm, or less, from an outer surface of the side wall of the container body, is desired because it allows for more convenient and less conspicuous storage, e.g., in one's pocket. However, the inventors have found that as the profile of the guard is reduced, the functionality of the child resistant closure may be adversely affected. Accordingly, there is a need for a child resistant closure having a small profile guard without a substantial corresponding loss of child resistant closure functionality.

Seals known in the art often include abutting surfaces on the cap and container body, which may be in the form of, for example, a protrusion on one of the cap or container body that is received by a groove on the other of the cap or container body. Similarly, closure mechanisms often include a protrusion on one of the cap and container body that is received by a groove on the other of the cap and container body, in order to form an interlocking relationship that retains the cap in place on the container body. Due to the similarity in structure of these common configurations, the seal and closure mechanism are often combined in a single structure including the above-mentioned protrusion and groove. This is potentially limiting to the integrity of both the seal and the closure mechanism, as different dimensions and constructions may be desirable for each of these components. For example, to create an effective seal, it may be desirable to form the outer dimensions of the cap as slightly larger than the inner dimensions of the container opening that receives a portion of the cap, in order to create an interference fit and in turn a tight seal. This can be problematic with respect to a closure mechanism, as it may cause deformation of the container body such that the closure mechanism portion thereof does not sufficiently engage the closure mechanism portion of the cap. Accordingly, a need exists for a container having a closure mechanism and seal that function independently of each other, such that varying the construction of one in order to maximize effectiveness does not negatively impact the effectiveness of the other.

SUMMARY

Accordingly, in one aspect, the present invention relates to a container that includes a body defining an interior and an opening that leads to the interior. A cap removably affixes over the opening to move the container between an opened position and a closed position. A child resistant closure moves between an engaged position and a disengaged position, and impedes moving the container from the closed position to the opened position when in the engaged position.

The child resistant closure may include a guard extending outwardly from the body, adjacent to the opening, a support frame extending from an inner surface of the guard towards the body, a protrusion extending from the support frame towards the inner surface of the guard and a catch extending from an underside of the cap. The catch has an aperture. The child resistant closure is movable between an engaged position and a disengaged position. The child resistant closure impedes movement of the container from the closed position to the opened position when in the engaged position. The engaged position includes disposal of the catch in a space between the support frame and the inner surface of the guard where the protrusion mates with the aperture.

In another aspect, the invention relates to a container that includes a body defining an interior and an opening that leads to the interior. A cap removably affixes over the opening to move the container between an opened position and a closed position. An engagement is formed between the body and the cap, and retains the cap over the opening when in the closed position. A seal is formed between the body and the cap when the container is in the closed position. The engagement and the seal are separate and independent of each other.

In another aspect, a method for opening a container is provided. The method includes providing a container and moving a cap on the container from a closed position to an opened position. The container includes a body a body having a base and a side wall extending up from the base leading to an opening that permits access to an interior of the body. The container further includes a cap pivotally secured to the body by a hinge. The cap is movable about the hinge with respect to the body to move the cap between a closed position in which the cap covers the opening to an opened position in which the opening is exposed. The container also includes a child resistant closure configured to impede moving the cap from the closed position to the opened position when the child resistant closure is in an engaged position. The child resistant closure includes a resilient guard extending radially outward from the body, adjacent to the opening. The guard in a fully extended position has an outer-most surface that is 4 mm or less from an outer surface of the side wall of the body and/or a guard width to depth ratio of at least 6:1. The child resistant closure also includes a front tab of the cap located opposite the hinge. The front tab has an underside configured for receiving upward pressure to pivot the cap from the closed position to the opened position. The engaged position of the child resistant closure includes the guard being in its fully extended position with the cap in the closed position, such that the guard blocks access to the underside of the front tab. The method further includes applying inward radial pressure on the guard sufficient to inwardly deflect the guard so as to displace at least a portion of the outer-most surface of the guard radially inward to a disengaged position of the child resistant closure. In the disengaged position, at least a portion of the underside of the front tab is exposed for manual application of upward pressure. After applying the aforesaid inward radial pressure, the method further includes applying upward pressure to the underside of the front tab to pivot the cap from the closed position to the opened position. Upon release of the inward radial pressure on the guard, the guard automatically returns to its fully extended position.

Optionally in any method according to the invention, after step lifting the cap, one may release the inward radial pressure on the guard, whereupon the guard automatically returns to its fully extended position.

Optionally in any method according to the invention, the guard is substantially flush with or extends radially outward relative to the front tab when the child resistant closure is in the engaged position.

Optionally in any method according to the invention, the cap has a top wall and a skirt extending downward from the top wall, about an outer perimeter of the top wall.

Optionally in any method according to the invention, the guard consists of a single strip of polymeric material.

Optionally in any method according to the invention, the strip has an outward facing surface that is substantially rounded.

Optionally in any method according to the invention, the guard in its fully extended position has an outer-most surface that is from 2 mm to 4 mm from the outer surface of the sidewall of the body.

Optionally in any method according to the invention, a seal is formed between the body and the cap when the container is in the closed position. The seal is not dependent upon the child resistant closure being in the engaged position or the disengaged position. Optionally, the seal is a moisture tight seal.

Optionally in any method according to the invention, the container is made from a single-shot of injection molded polymeric material.

Optionally in any method according to the invention, the guard has first and second inner ends that are respective locations of attachment of an inside of the guard to the outer surface of the side wall of the body. The guard has a width ($W_G$) measured in a straight line from the first inner end to the second inner end. The guard has a depth ($D_G$) measured in a straight line from the outer surface of the side wall to the outer-most surface of the guard. The ratio of $W_G$:$D_G$ is at least 6:1.

Optionally in any method according to the invention, the container is held by a single hand and the child resistant closure is disengaged and the cap is opened using the single hand.

Optionally in any method according to the invention, the guard consists of a single strip of polymeric material. The strip has an outward facing surface that is substantially rounded. The guard includes axially extending channels formed on an inner surface of the guard facing the side wall of the body. The channels serve as bending points of the guard to facilitate inward deflection of the guard when the guard is depressed.

DETAILED DESCRIPTION OF THE PREFERRED EMBODIMENTS

Figure 1:
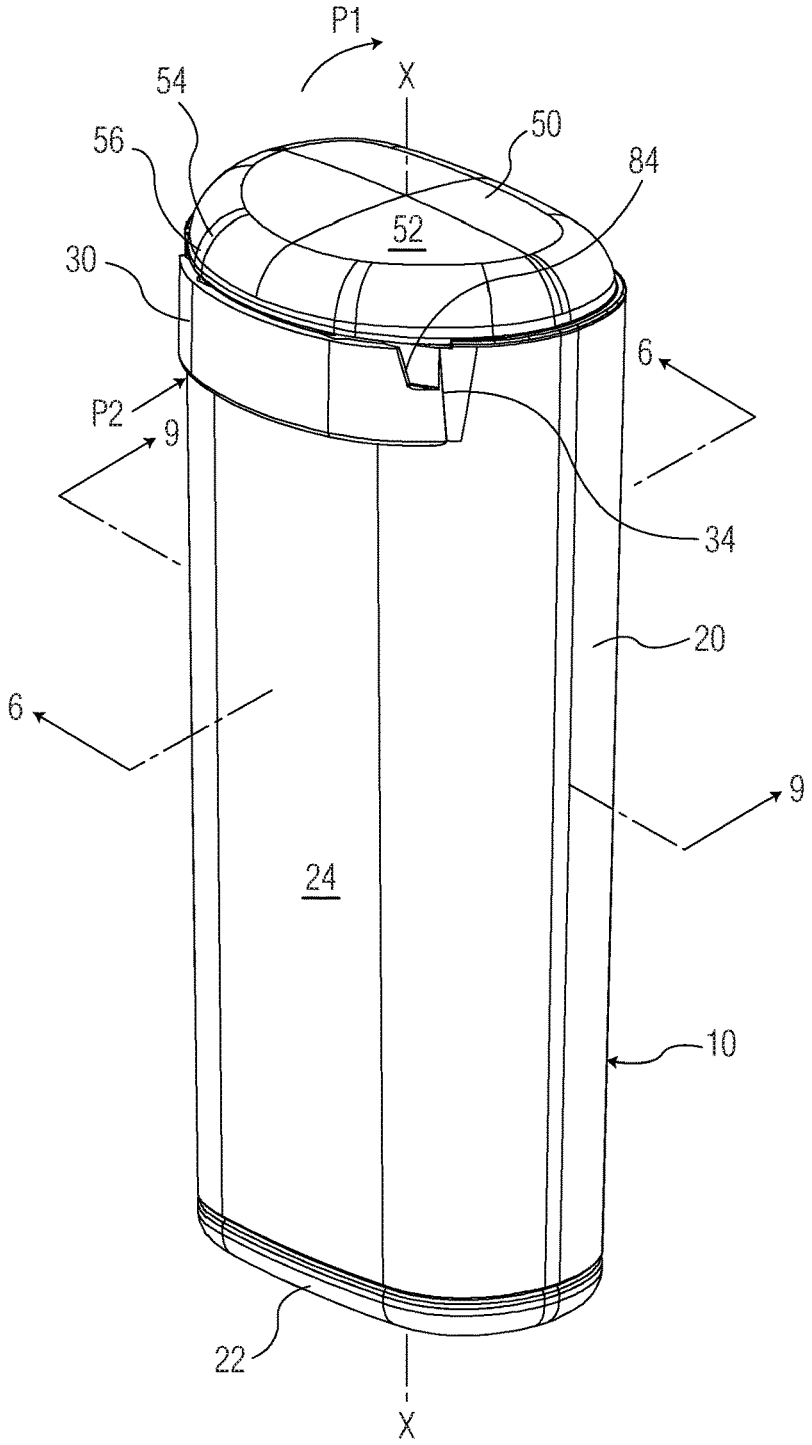
FIG. 1 is a front perspective view of an exemplary embodiment of a container according to the invention, in a closed position.
Figure 2:
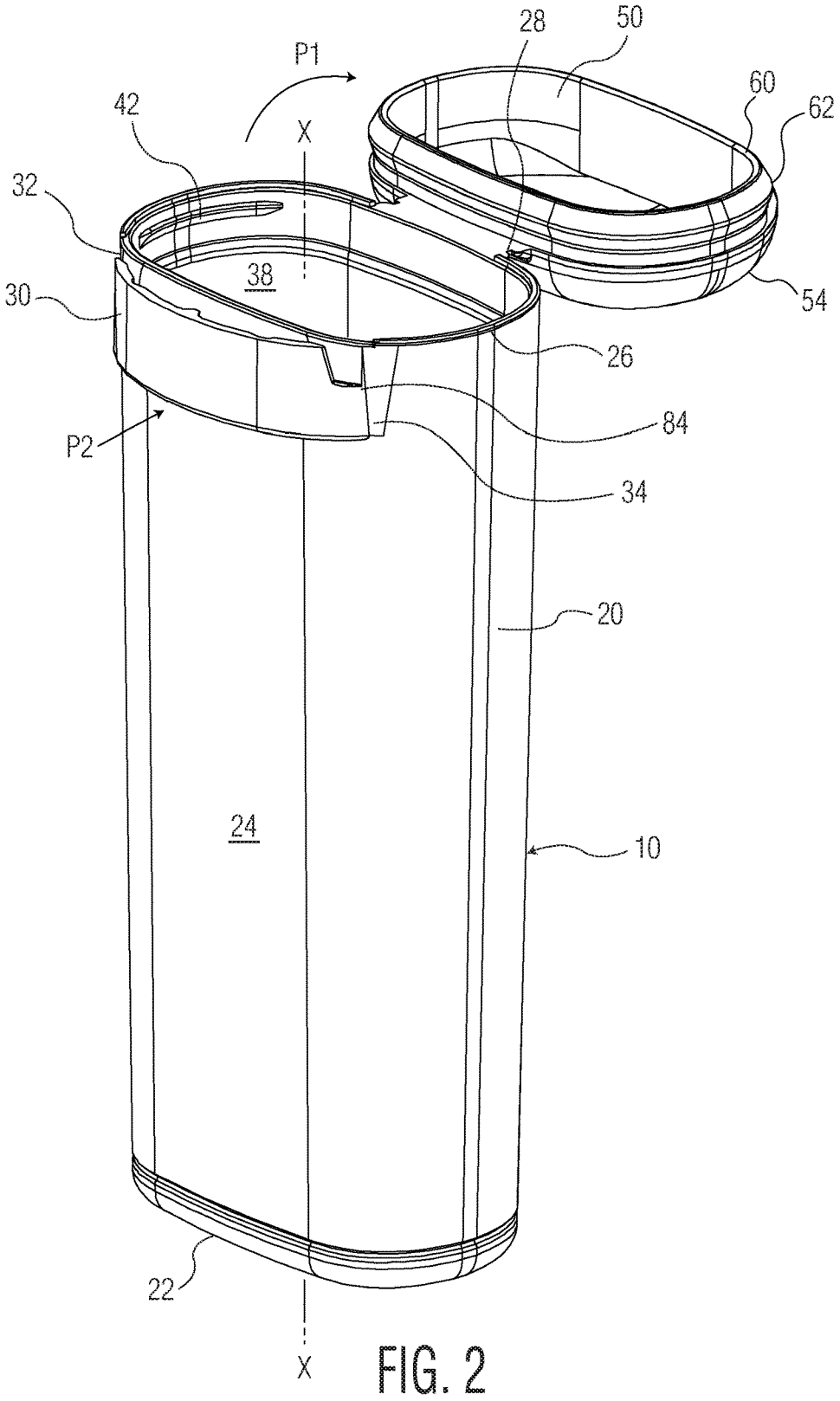
FIG. 2 is a front perspective view of the container of FIG. 1, in an opened position.

Detailed embodiments of the present invention are disclosed herein, but it should be understood that the disclosed embodiments are merely exemplary of the invention, which may be embodied in various forms. The figures are not necessarily to scale; some features may be exaggerated to show details of particular components. Therefore, specific structural and functional details disclosed herein are not to be interpreted as limiting, but merely as a basis for the claims and as a representative basis for teaching one skilled in the art to variously employ the present invention.

Certain terminology is used in the foregoing description for convenience and is not intended to be limiting. Words such as "front," "back," "top," and "bottom" designate directions in the drawings to which reference is made. This terminology includes the words specifically noted above, derivatives thereof, and words of similar import. Additionally, the words "a" and "one" are defined as including one or more of the referenced item unless specifically noted. The phrase "at least one of" followed by a list of two or more items, such as "A, B or C," means any individual one of A, B or C, as well as any combination thereof.

An exemplary container 10 according to the invention is shown in FIGS. 1-10. In the embodiment shown, the container 10 is in the form of a vial. As shown, the container 10 includes a body 20 and a cap 50. The body 20 includes a base wall 22 and a tubular side wall 24 that extends upward from the base wall 22 about an outer perimeter thereof. The base wall 22 and side wall 24 together define a container interior 12 for housing a plurality of products. In the illustrated embodiment, the base wall 22 is of an oval shape and the side wall 24 has a similar oval cross section, but the container body 20 could take on other shapes as well. An opening 26 leading to the interior 12 is defined by an upper edge of the side wall 24. The cap 50 is configured to removably affix over the opening 26 to move the container 10 between an opened position in which the opening 26 is exposed, as shown in FIGS. 2-5, and a closed position in which the cap 50 covers the opening 26, as shown in FIG. 1. The cap 50 may be pivotally attached to the container body 20 by a hinge 28, which allows the cap 50 to pivot between the opened position and the closed position. The container 10 includes a seal 90 formed between the body 20 and the cap 50, as well as an engagement 92 to retain the cap 50 on the body 20 when in the closed position. The seal 90 and engagement 92 are separate and independent of each other.

Optionally in any embodiment, the integrity of the seal is dependent only on whether the container is opened or closed; the seal is not dependent upon the child resistant closure being in the engaged position or the disengaged position.

The seal of the container 10 of the present invention may be a moisture-tight seal. As used herein, the term "moisture-tight" is defined as having a moisture ingress (after three days) of less than 1500 micrograms of water, in another embodiment, less than 500 micrograms of water, in a further embodiment, less than 300 micrograms of water, in yet another embodiment, less than 150 micrograms of water, determined by the following test method: (a) place one gram plus or minus 0.25 grams of molecular sieve in the container and record the weight; (b) fully close the container; (c) place the closed container in an environmental chamber at conditions of 80% relative humidity and 72° F.; (c) after one day, weigh the container containing the molecular sieve; (d) after four days, weigh the container containing the molecular sieve; and (e) subtract the first day sample from the fourth day sample to calculate the moisture ingress of the container in units of micrograms of water.

The cap 50 includes a top wall 52 and an outer skirt 54 extending downwardly therefrom, about an outer perimeter thereof. In the illustrated embodiment, the top wall 52 and the skirt 54 are curved downward towards the container body 20, forming a substantially oval dome shape. When the container 10 is in the closed position, a lower portion of the skirt 54 meets with an upper portion of the side wall 24 to close the container 10. The hinge 28 extends between the skirt 54 and upper edge of the side wall 24 to pivotally join the cap 50 with the body 20. In the illustrated embodiment, the hinge 28 is of the living hinge type, i.e., formed integrally with the body 20 and cap 50, for example by co-molding or simply being formed as a continuation of the material of the body 20 and cap 50. This can be achieved, for example, by molding the body 50 and cap 20 together, such that they are joined by a section of material thin enough so as to permit folding, and in turn pivoting between the body 50 and cap 20. In other embodiments, the hinge 28 could be a separate mechanical element affixed to the body 20 and cap 50.

The cap 50 further includes a front tab 56. The tab 56 extends forward from a front portion of the cap 50, located opposite the hinge 28. In the illustrated embodiment, the tab 56 is simply an irregular extension along the front of the cap 50, and includes portions of both the top wall 52 and the skirt 54. The tab 56 serves to provide a user with access to a front, underside portion of the cap 50 in order to initiate pivoting outwardly in direction P1, to open the container 10.

Figure 5:
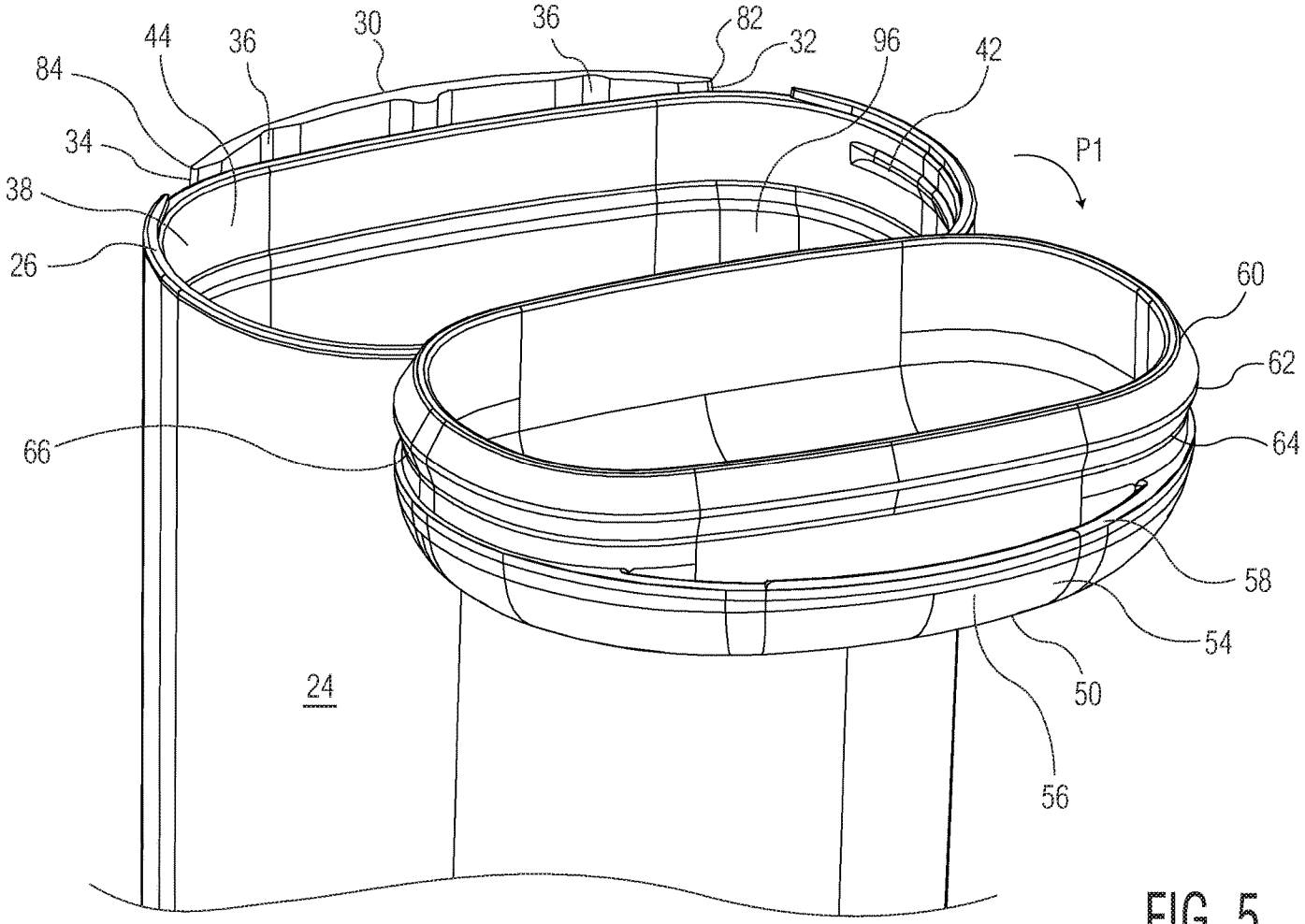
FIG. 5 is an enlarged detail of FIG. 4.
Figure 5A:
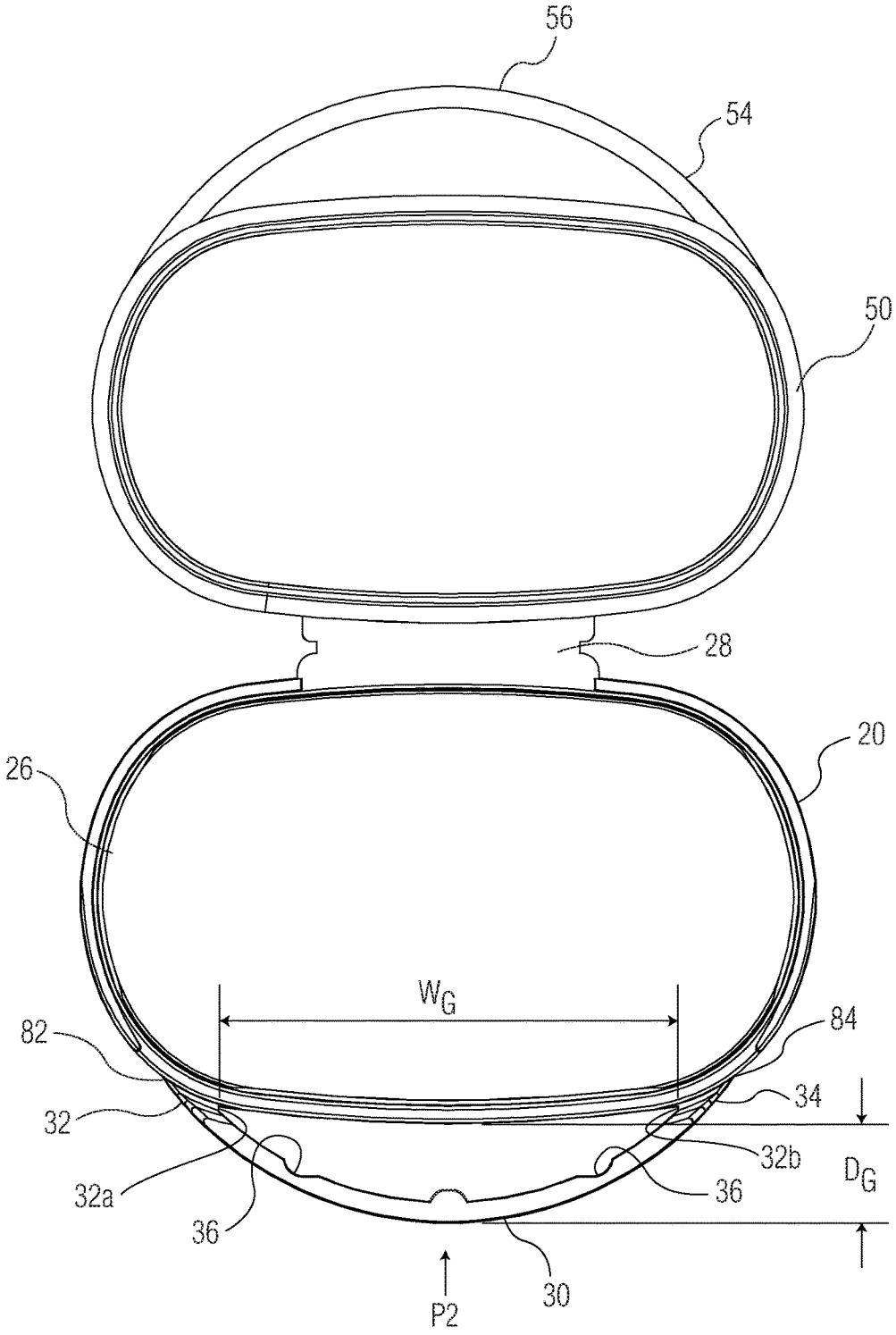
FIG. 5A is a top view of the container of FIG. 1, in an opened position.
Figure 6:
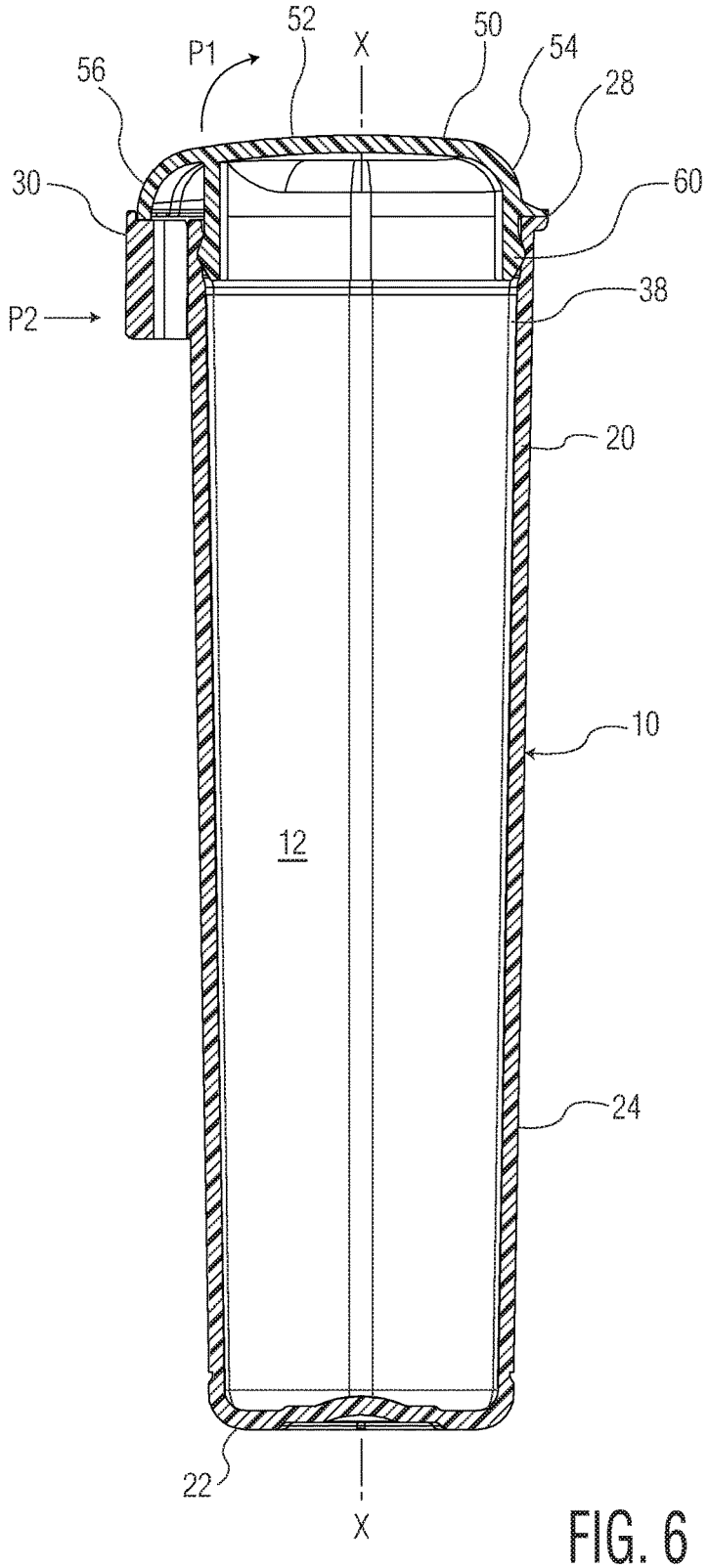
FIG. 6 is a cross section taken along line 6-6 of FIG. 1.
Figure 7:
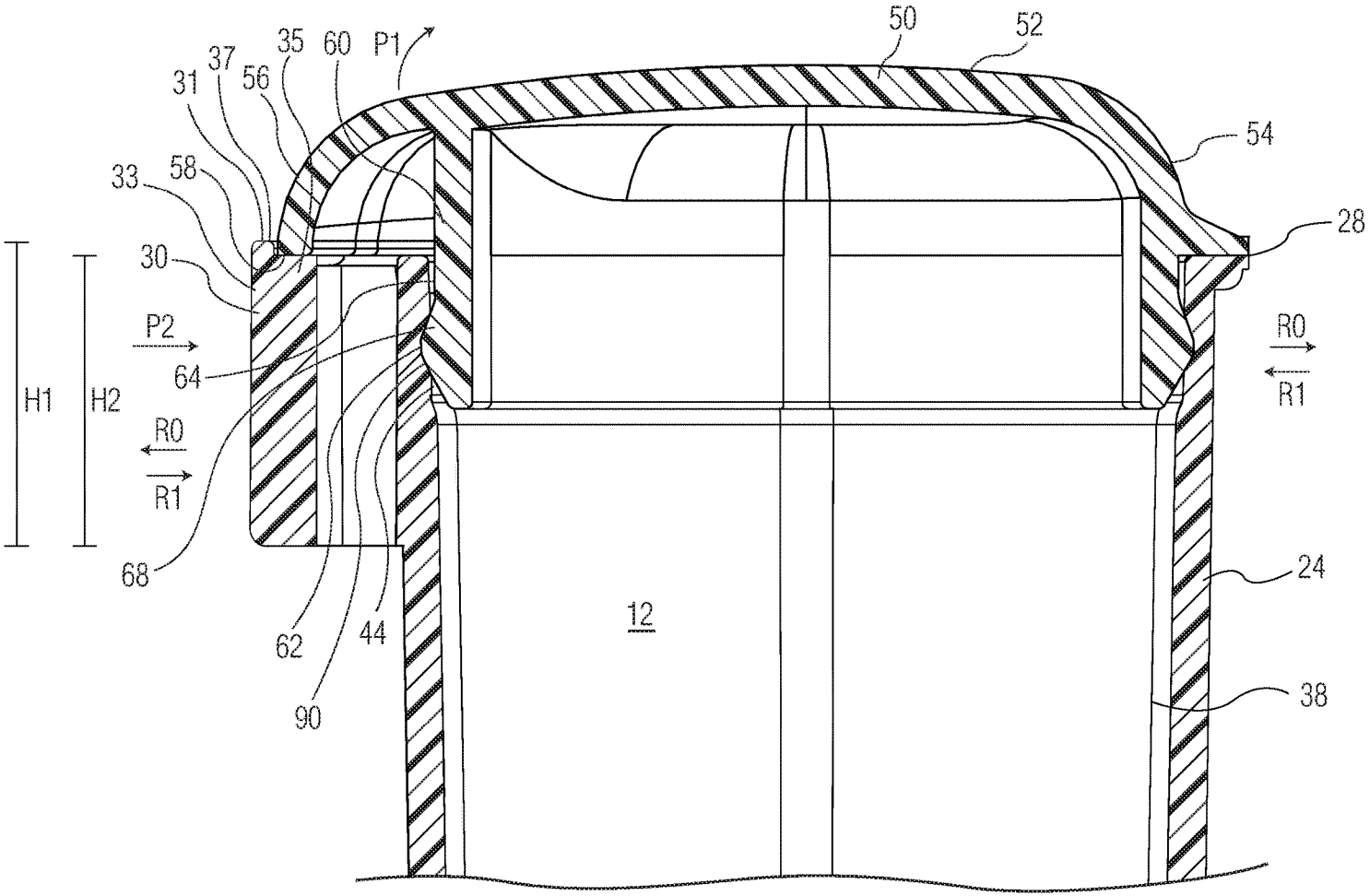
FIG. 7 is an enlarged detail of FIG. 6.

As shown in FIGS. 1-3, 5, 5A, 6 and 7, a guard 30 extends forward from a front portion of the side wall 24, near the top thereof, at a location beneath the tab 56 when the container 10 is in the closed position, and opposite the hinge 28. As shown, the guard 30 is formed as a strip projecting from a front portion of the side wall 24. The guard 30 has first and second outer ends 32, 34 attached to the side wall, extends in a direction perpendicular to a central axis X of the side wall, and curves outwardly from the side wall 24 between the first and second outer ends 32, 34. Optionally, the outward facing surface of the guard is substantially rounded. The guard 30 is constructed of a resilient material, optionally a plastic or thermoplastic material. When the container 10 is in the closed position, as shown in FIGS. 1, 6 and 7, the outer surface of the guard 30 is substantially flush with the outer surface of the skirt portion of the tab 56. The guard 30 may extend slightly further out in the radial direction of the container 10 than the skirt portion of the tab 56. The guard 30 may serve as a safety mechanism, for example as part of a child resistant closure mechanism that moves between an engaged position and a disengaged position, to impede opening of the container 10 by undesired individuals, such as children, when in the engaged position.

Referring to FIG. 5A, the guard 30 includes first and second inner ends 32*a*, 34*b* which are the respective locations of attachment of the inside of the guard 30 to the side wall 24. An important aspect of the guard is that it have a small profile without a substantial corresponding loss of child resistant closure functionality—a problem that was not adequately addressed in the prior art. In nominal terms, it is preferred that the outer-most surface of the guard 30 is preferably 4 mm or less from an outer surface of the side wall 24 of the container body 20. In addition or in the alternative, the low profile may be expressed as a ratio of the width of the guard to the depth of the guard. The width of the guard $W_G$ is measured in a straight line from the first inner end 32*a* to the second inner end 34*b*. The depth of the guard $D_G$ is measured in a straight line from an outermost surface of the side wall 24 of the container body 20 to the outer-most surface of the guard. In an optional embodiment, $W_G$ is about or exactly 25 mm and $D_G$ is about or exactly 4 mm. Optionally, in any embodiment, the ratio of $W_G$:$D_G$ is 6.25:1. Optionally, in any embodiment, the ratio of $W_G$:$D_G$ is at least 5:1, optionally at least 6:1, optionally at least 7:1, optionally at least 8:1, optionally at least 9:1, optionally at least 10:1. Optionally, in any embodiment, the ratio of $W_G$:$D_G$ is from 5:1 to 10:1, optionally from 6:1 to 10:1, optionally from 6:1 to 9:1.

Figure 8:
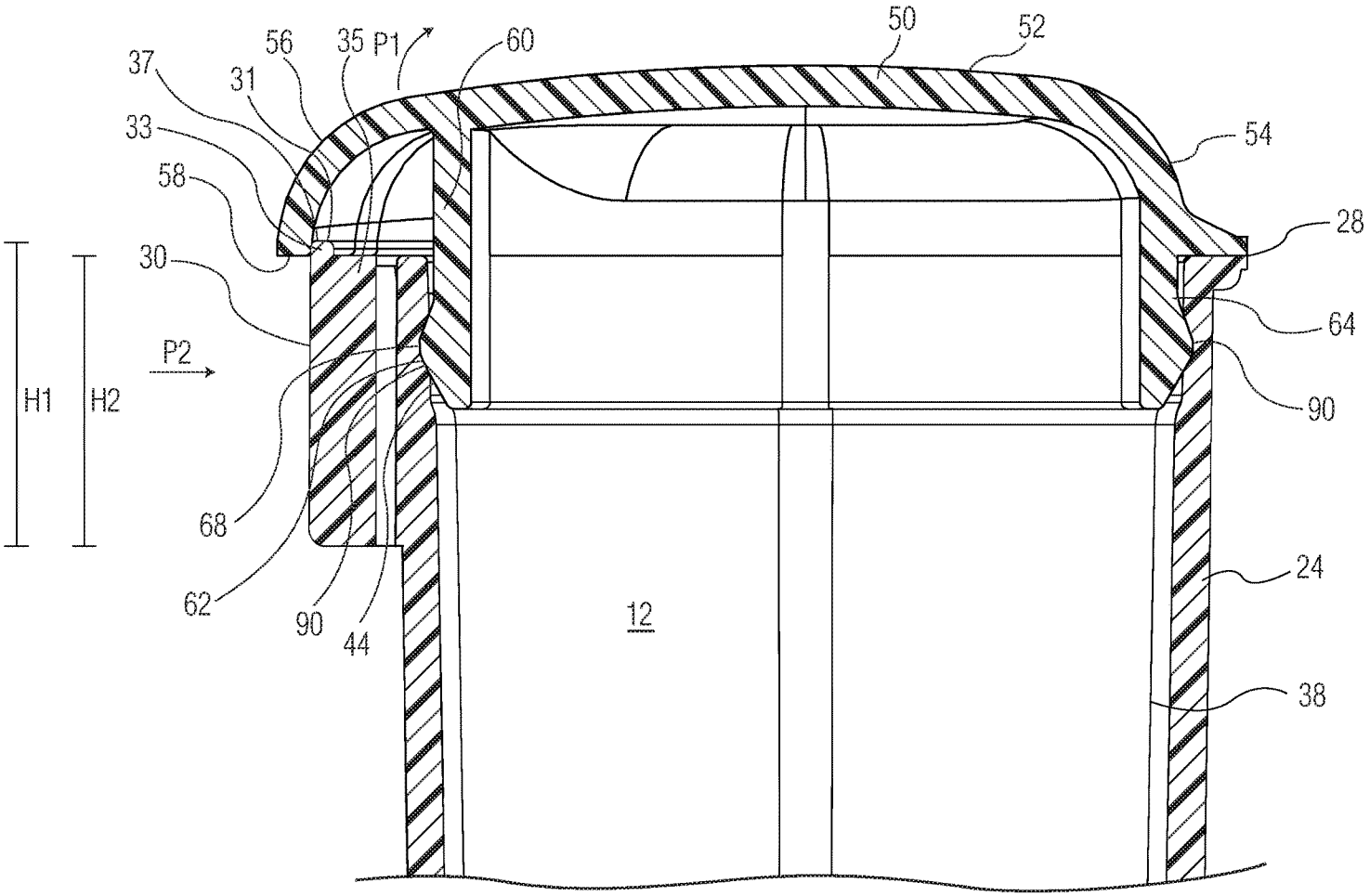
FIG. 8 is an enlarged cross sectional view of the container as shown in FIG. 7, with the guard in a depressed position.

In order to open the container 10, the child resistant closure is moved from the engaged position, shown in FIG. 7, to the disengaged position, shown in FIG. 8. To accomplish this, guard 30 is first depressed in direction P2, causing it to deform inwardly, from the position shown in FIG. 7 to the position shown in FIG. 8, such that the user can access the underside 58 of tab 56. As further shown in FIGS. 7 and 8, the guard 30 includes a step 31 formed on the top surface thereof. The step 31 divides the guard 30 into a front portion 33 that is located radially outward with respect to the tab 56 and a rear portion 35 that is located axially beneath the tab 56. The front portion 33 has a first height H1 and the rear portion 35 has a second height H2. The first height H1 is greater than the second height H2, as measured in the axial direction of the container 10. An upper protrusion 37 formed by the step 31 and formed at the top of front portion 33 sits directly in front of (radially outward with respect to) a bottom portion of the tab 56 when the container 10 is in the closed position. This prevents the guard 30 from being depressed inward in direction P2, unless a sufficient force is applied so as to deform the protrusion 37 and/or the tab 56 so as to permit the guard 30 to move inward, past the tab 56. As used herein, the term "sufficient force" is defined as a force above a threshold force that causes sufficient deformation in the protrusion 37 and/or the tab 56 so as to permit the guard 30 to move radially inward in direction P2, past the tab 56.

The guard 30 may include axially extending channels 36 formed on the inner surface thereof, facing the side wall 24. The channels 36 can serve as bending points of the guard 30 to facilitate deformation in direction P2. Notches 82, 84 may optionally be formed between the guard 30 and the side wall 24 to which the guard 30 is attached, adjacent to the first and second outer ends 32, 34 of the guard and extending downward from the upper edge thereof. Notches 82, 84 may further facilitate bending the guard 30 to cause deformation in direction P2. For some embodiments, however, it may be preferred to omit notches to the extent that they may undesirably provide an access point for prying open the cap (e.g., with fingers or teeth), thus circumventing the child resistant closure. Once the guard 30 is depressed sufficiently in direction P2 so as to expose the underside 58 of tab 56, the user can force the tab 56 and in turn the cap 50 to pivot in direction P1, by applying force to the underside 58 of tab 56 in direction P1. The guard 30 is resilient and biased to the engaged position shown in FIGS. 1-7, such that it returns to that shape when the pressure in direction P2 is released.

In one embodiment, the above-described deformation in the protrusion 37 and/or tab 56 causes a snapping back into position of the protrusion 37 and/or the tab 56, once the guard 30 is moved past the tab 56. This snapping may result in a sound that alerts the user that the child resistant mechanism has been moved into the disengaged position and the container 10 can be opened in the manner described above.

The seal 90 and engagement 92 mechanisms of the present invention will now be described in detail. In the illustrated embodiment, the seal 90 is located below the engagement 92 in an axial direction of the container body 20. In other embodiments, this configuration could be reversed, such that the engagement 92 is located below the seal 90 in the axial direction of the container body 20. In the illustrated embodiment, the seal 90 and engagement 92 each comprise abutments between surfaces of the container cap 50 and body 20, in which pressure is applied in opposite radial directions. In the illustrated embodiment, pressure is applied in an outward radial RO direction by abutting surfaces forming the seal 90, and in an inward radial direction RI by abutting surfaces forming the engagement 92. In other embodiments, this configuration could be reversed, such that pressure is applied in an inward radial direction RI by abutting surfaces forming the engagement 92, and in an outward radial direction RO by abutting surfaces forming the seal 90.

FIGS. 6, 7, 9 and 10 show the seal formed between the body 20 and the cap 50. As shown, the cap 50 includes a downwardly extending lip 60, which is configured to fit snugly within the side wall 24 of the body 20. The lip 60 may take on the configuration shown, in which it extends downward from the skirt 54 about most of the perimeter of the cap 50, with the exception of the portion of the skirt 54 forming the tab 56, at which portion the lip 60 simply extends across the front of the cap 50 in a path that is straight, substantially straight, or simply configured to match that of the side wall 24.

As shown in FIGS. 6, 7, 9 and 10, the lip 60 includes an outwardly extending sealing protrusion 62. The sealing protrusion 62 extends around the entire outer surface 64 of the lip 60. In one embodiment, the inner surface 38 of the side wall 24 includes a sealing groove configured to receive the sealing protrusion 62 when the container 10 is in the closed position. The lip 60 and sealing protrusion 62 preferably engage the side wall 24 in an interference fit, to form a sealed relationship therebetween. The lip 60 and side wall 24 have sealing surfaces 44, 68 that contact each other in a sealed relationship when the container 10 is in the closed position.

The outer diameter of the lip 60, and in particular the portion of the lip 60 including the sealing protrusion 62, may be substantially equal to, or slightly greater than the inner diameter of the side wall 24, and in particular the portion of the side wall 24 defining the sealing surface 44. By employing this configuration, the lip 60 is slightly compressed by the side wall 24, to ensure contact between the two when the container 10 is in the closed position and the lip 60 is received by the side wall 24, to form a seal therebetween. The difference in diameters should be great enough so as to create such continuous contact, but not so great so as to cause undue deformation in the shape of the container body 20, due to excess outward pressure on the side wall 24 from the lip 60. A person of ordinary skill in the art would be capable of selecting the appropriate dimensions of these components so as to maximize the sealing capacity of the container 10.

Figure 9:
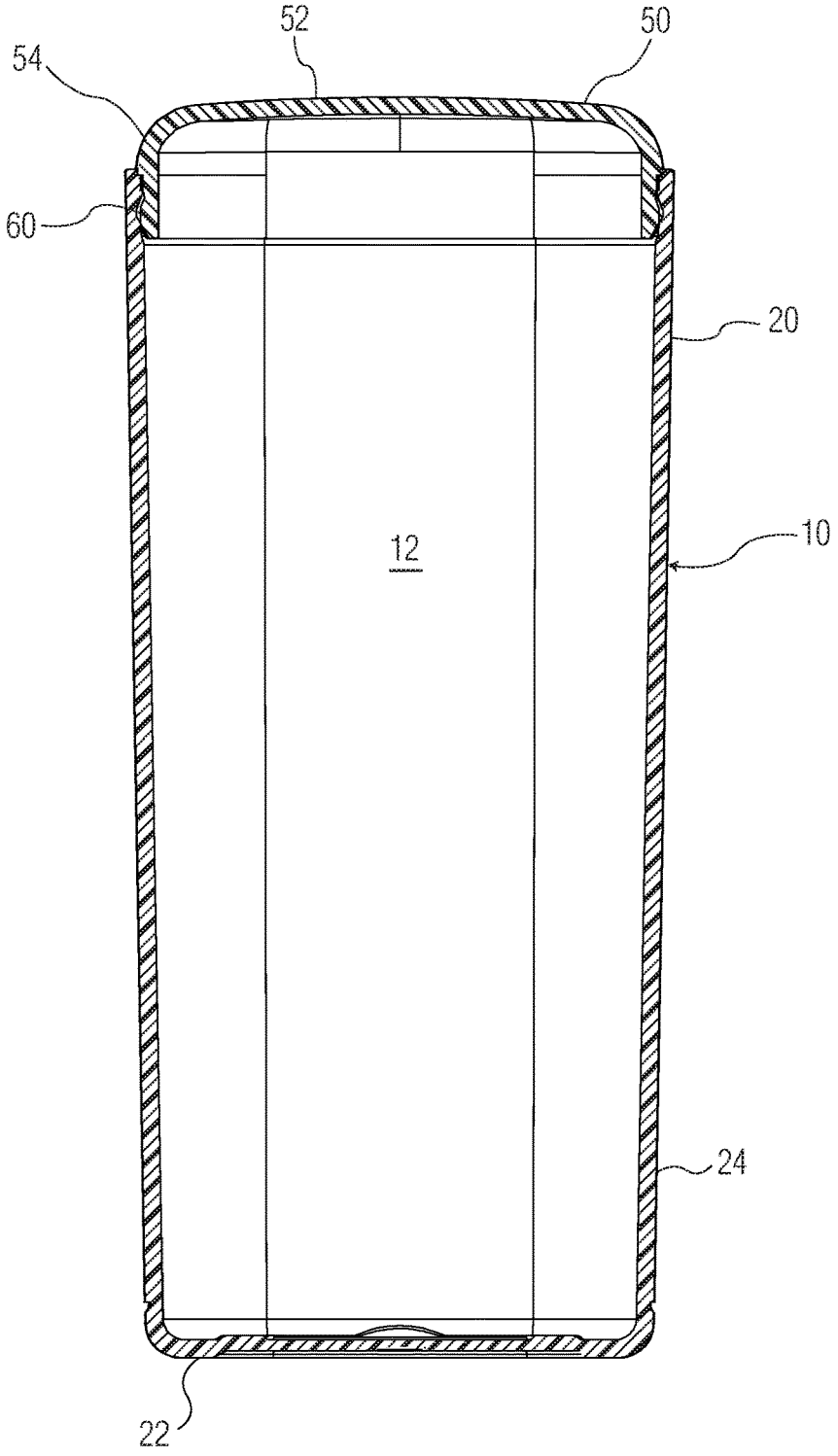
FIG. 9 is a cross section taken along line 9-9 of FIG. 1.
Figure 10:
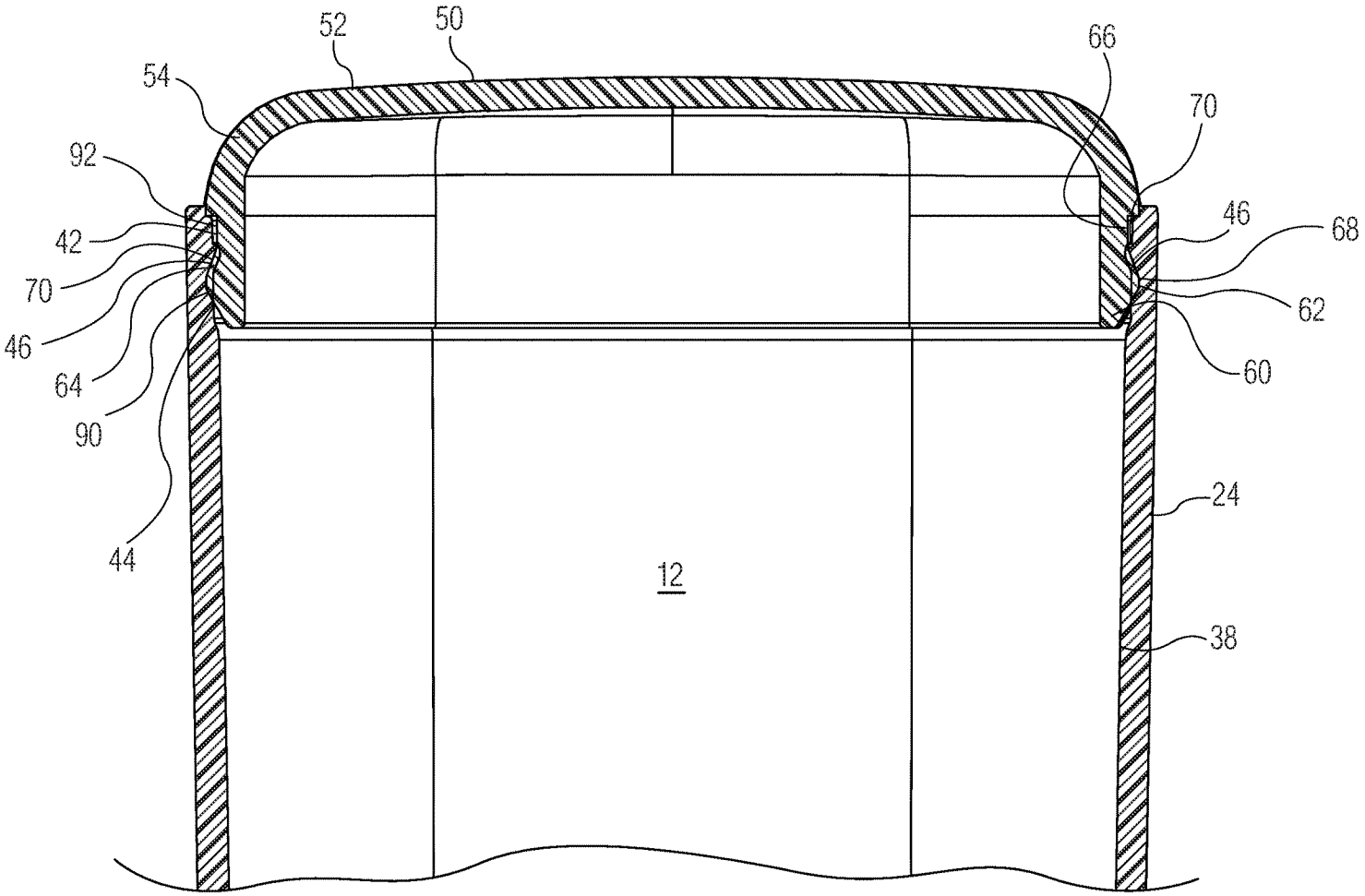
FIG. 10 is an enlarged detail of FIG. 9.

FIGS. 9 and 10 show the engagement between the body 20 and the cap 50. As shown, the lip 60 includes an inwardly extending engagement groove 66, located on the outer surface 64 thereof, above the sealing protrusion 62. The side wall 24 includes an outwardly extending engagement protrusion 42, located on the inner surface 38 thereof, above the sealing surface 44. The engagement groove 66 is configured to receive the engagement protrusion 42 in a snapping engagement when the container 10 is in the closed position. The engagement protrusion 42 and engagement groove 66 are preferably configured to interlock in a snapping engagement, i.e., to only permit removal of the engagement protrusion 42 from the engagement groove 66 and in turn disengagement of the cap 50 from the body 20 when a preselected amount of force is applied, to cause sufficient deformation of the side wall 24 in a radially outward direction RO and/or deformation of the lip 60 in an radially inward direction RI to permit release of the engagement and in turn the cap 50 from the container body 20. Such force is applied by pivoting the cap 50 in direction P1 as described above. A person of ordinary skill in the art would be capable of selecting the appropriate sizes and shapes for the engagement protrusion 42 and groove 66 to achieve this end. The engagement protrusion 42 and groove 66 include engagement surfaces 46, 70 that are substantially horizontal or perpendicular to the central axis x of the container 10. When the container 10 is in the closed position, the cap engagement surface 70 is below side wall engagement surface 46.

In the illustrated embodiment, the engagement protrusion 42 and groove 66 each only extend partially around the side wall 24 and lip 60, along opposite sides thereof, between the hinge 28 and tab 56 locations. The engagement protrusion 42 and groove 66 could alternatively be located at other portions of the side wall 24 and lip 60, or could extend all of the way around these components.

Figure 3:
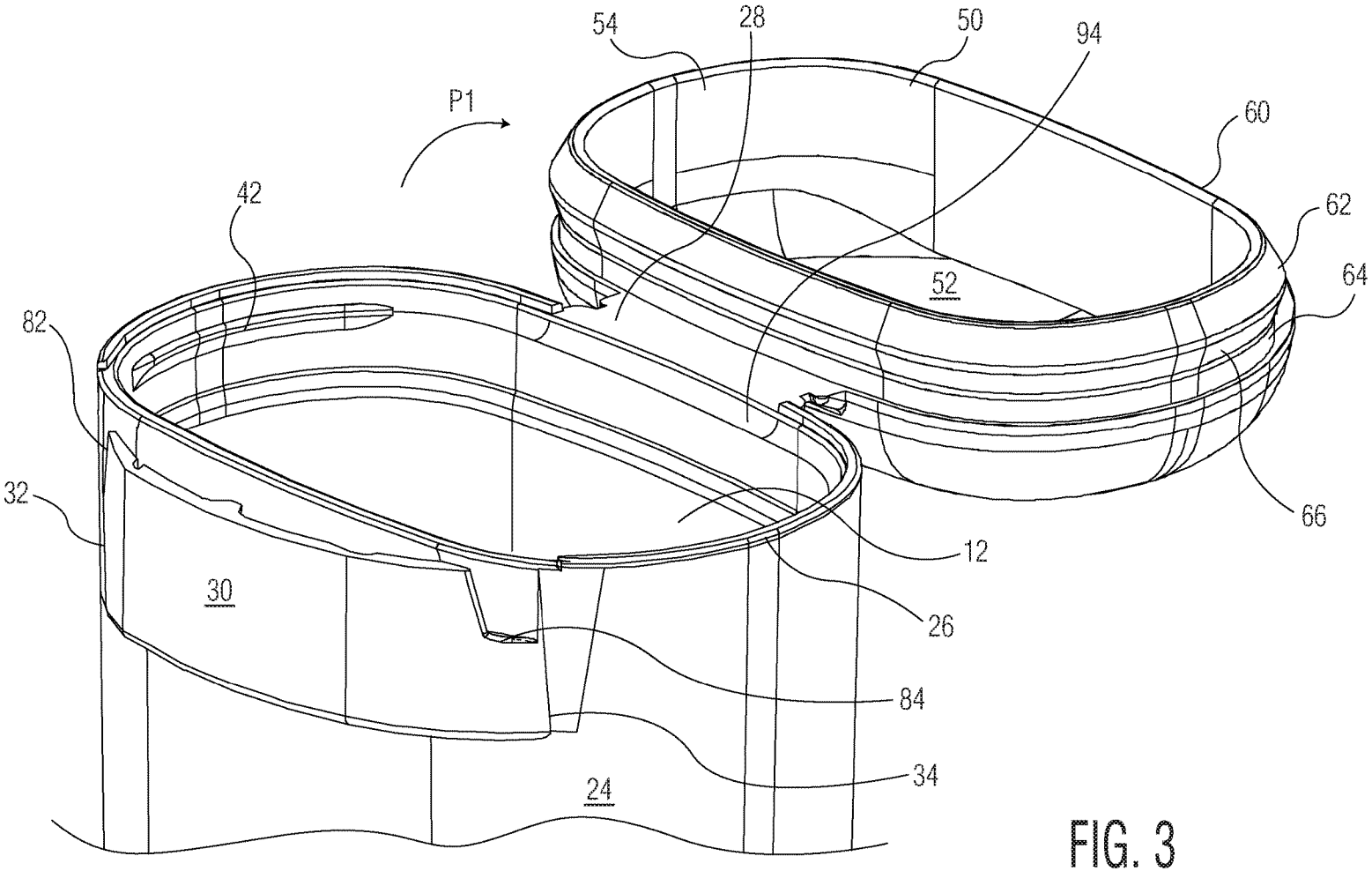
FIG. 3 is an enlarged detail of FIG. 2.
Figure 4:
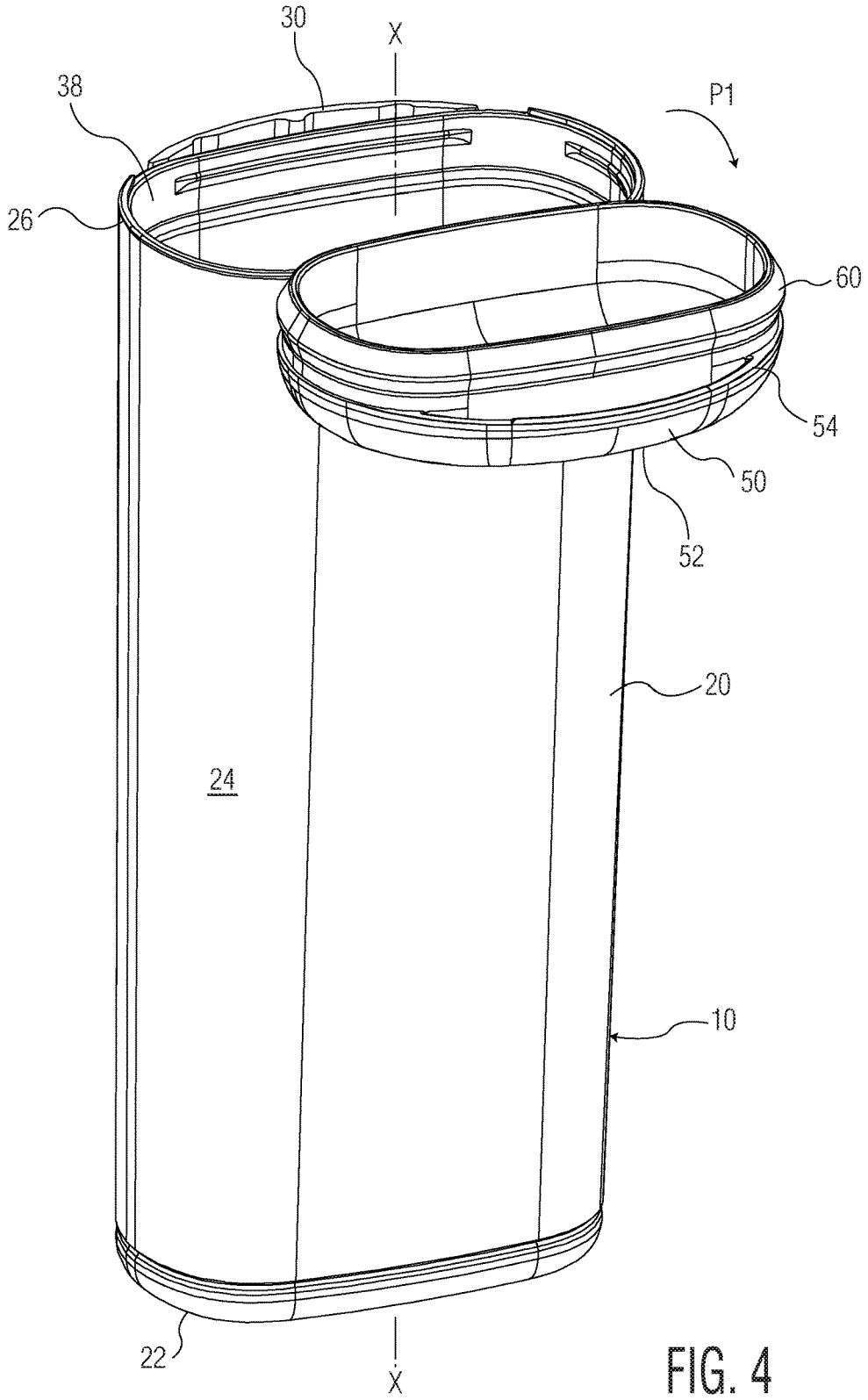
FIG. 4 is a rear perspective view of the container of FIG. 1, in an opened position.

FIGS. 3 and 5 show the locations of sink marks formed during molding of the container. As shown in FIG. 3, a hinge sink mark 94 is formed on the inner surface 38 of the side wall 24 directly below the hinge. According to the configuration shown in the drawings, the hinge sink mark 94 advantageously does not interfere with the engagement protrusion 42, which extends only around portions of the side wall 24, as just described.

As shown in FIG. 5, two guard sink marks 96, 98 are formed on the inner surface of the side wall 24 at locations approximately aligned with the first and second outer ends 32, 34 of the guard 30. These sink marks are advantageously formed below the sealing surface 44. The location of the guard sink marks can be adjusted by modifying the length of the notches 82, 84. Lengthening the notches 82, 84 lowers the location of guard sink marks, 96, 98, while shortening the length of notches 82, 84 raises the location of guard sink marks 96, 98. Accordingly, notches 82, 84 are preferably formed having sufficient length so as to locate guard sink marks 96, 98 directly below the sealing surface 44.

Referring now to FIGS. 11-17, there is shown an alternative embodiment of a container 110 according to the present invention. In the embodiment shown, the container 110 is in the form of a vial. The container 110 may include some, substantially all, or all features of the container 10 of FIGS. 1-10 described above, such as the basic design, shape, container structure, seal structure, moisture-tightness of seal, etc. The following description of the container 110 is intended to provide a frame of reference or context for the child resistant closure that may be incorporated onto the container 110. Other aspects of the container 110 that are not explicitly set forth herein with reference to the container 110 of FIGS. 11-17 are described above with respect to the container 10 of FIGS. 1-10 and may be equally applicable to, and are incorporated by reference with respect to, the container 110.

Figure 11:
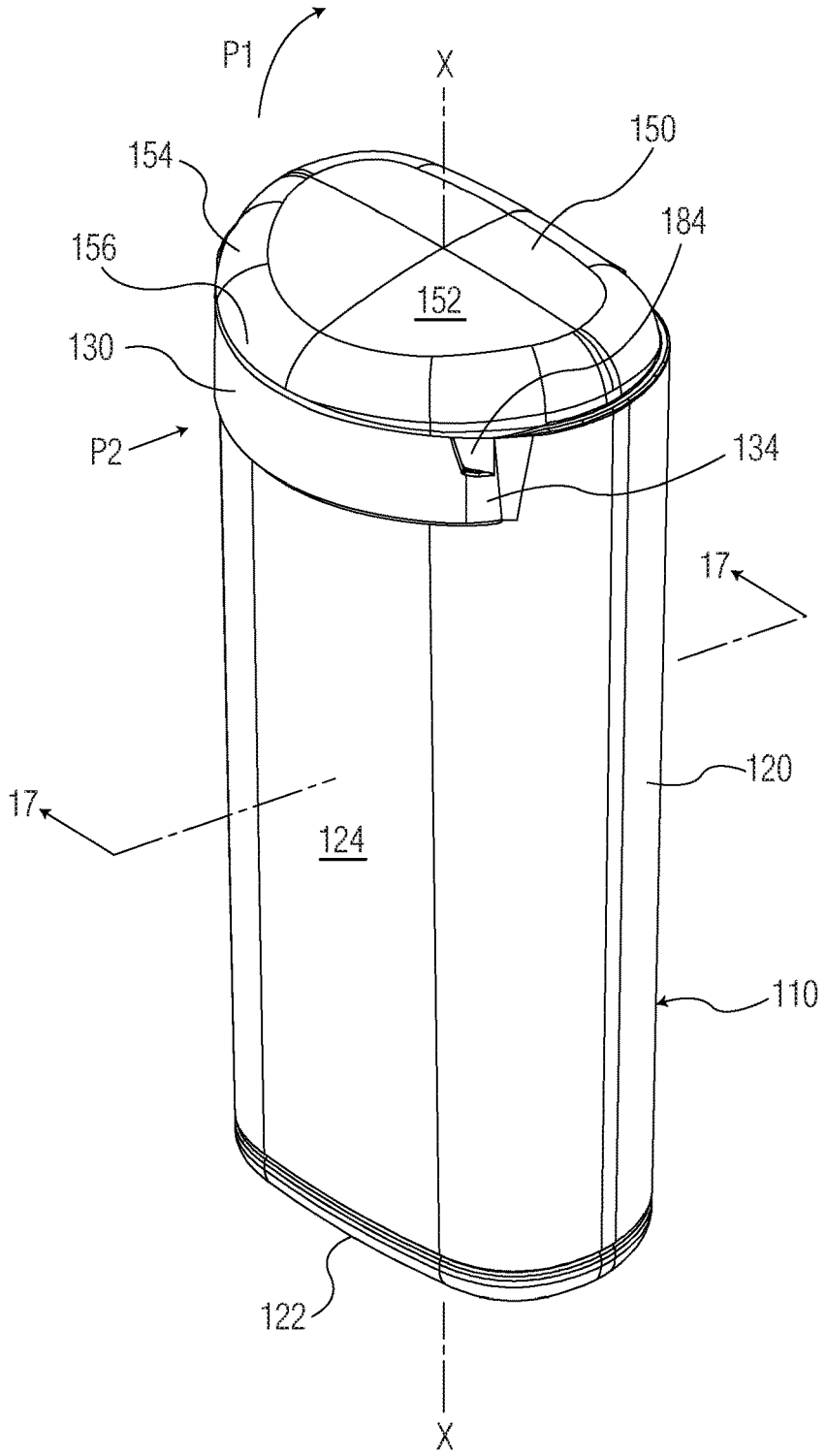
FIG. 11 is a front perspective view of an alternative embodiment of a container according to the invention, in a closed position.
Figure 12:
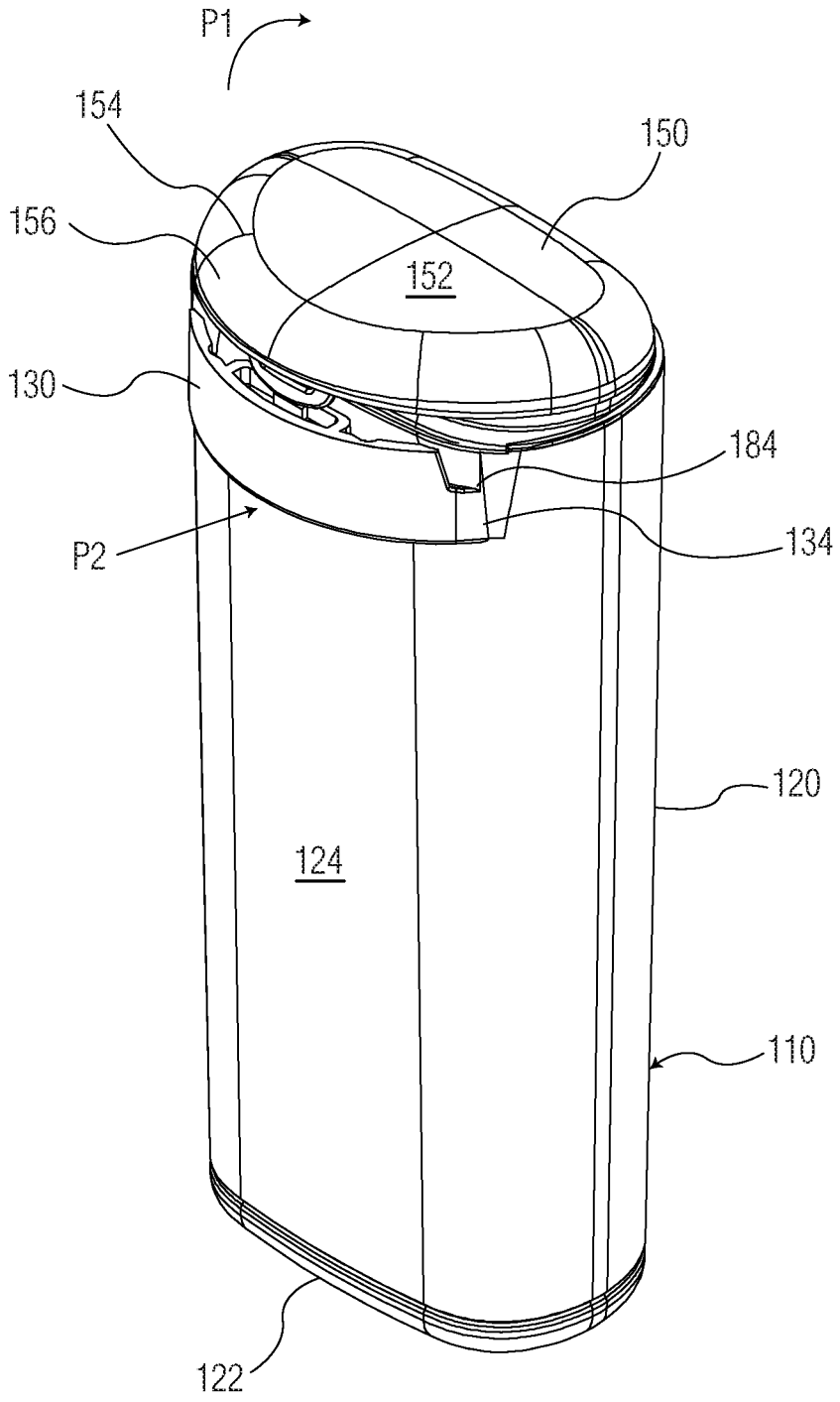
FIG. 12 is a front perspective view of the container of FIG. 11, in a partially opened position.
Figure 13:
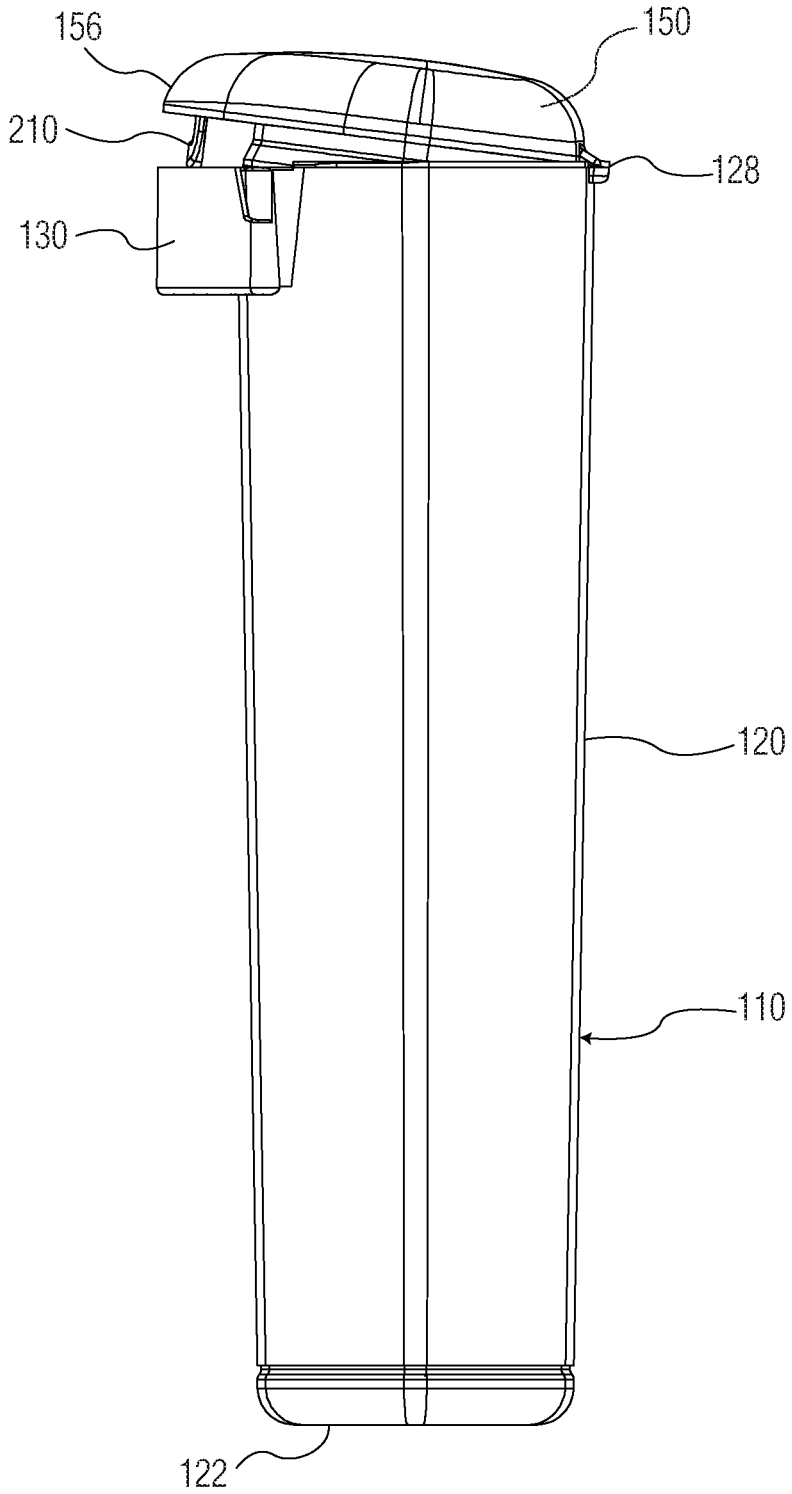
FIG. 13 is a side view of FIG. 12.
Figure 14:
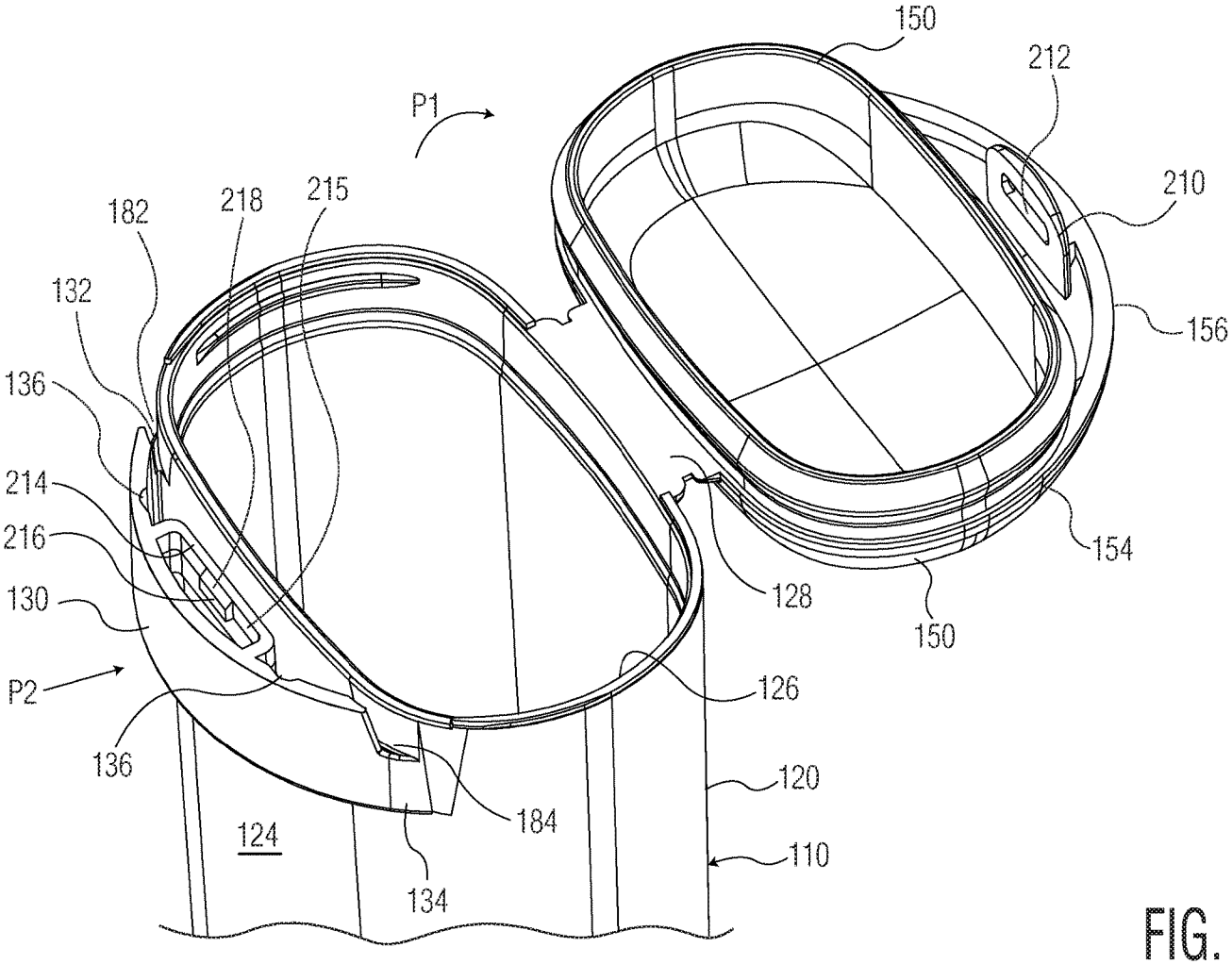
FIG. 14 is an enlarged detail of a front perspective view of the container of FIG. 11, in an opened position.
Figure 15:
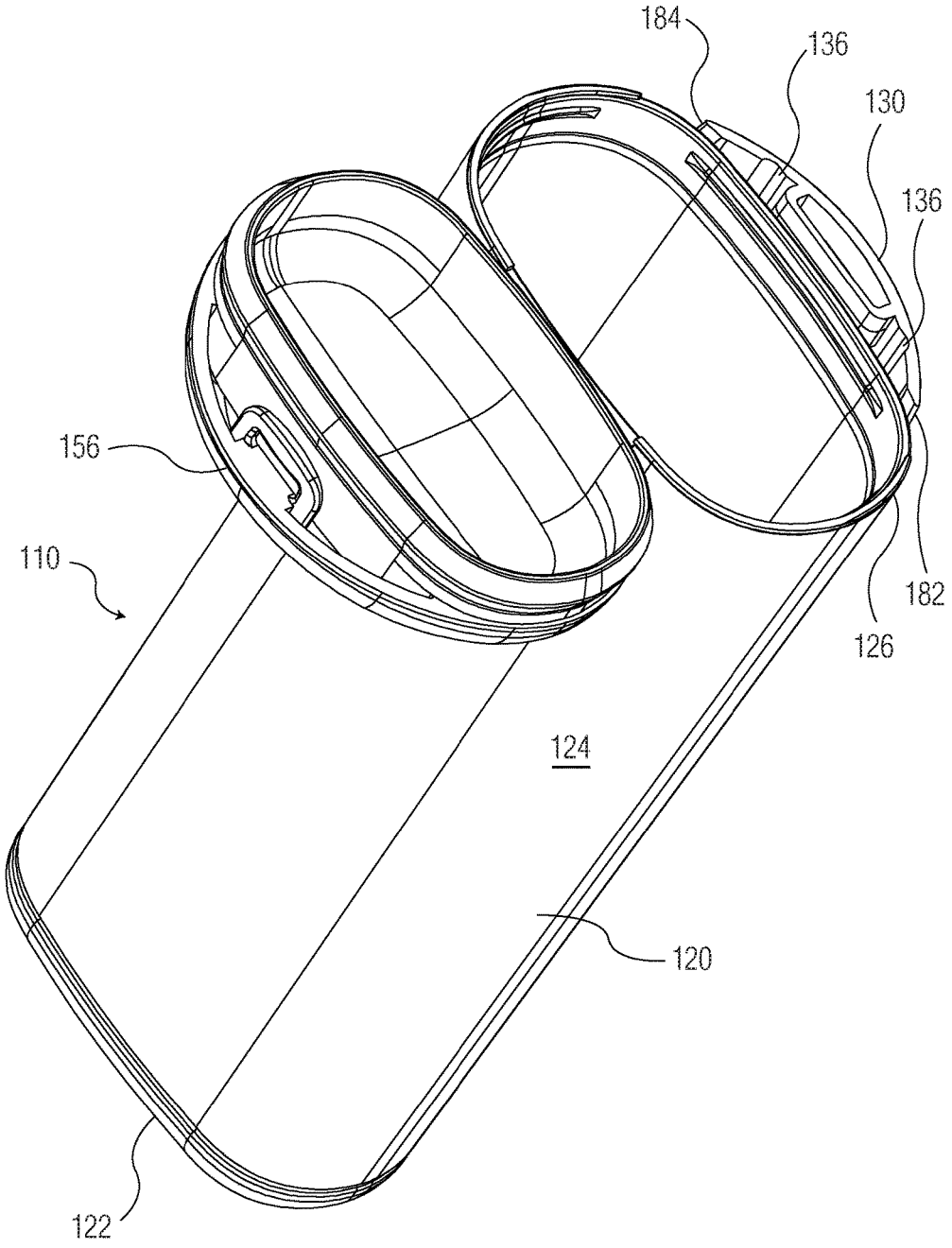
FIG. 15 is a rear perspective view of the container of FIG. 11, in an opened position.
Figure 16:
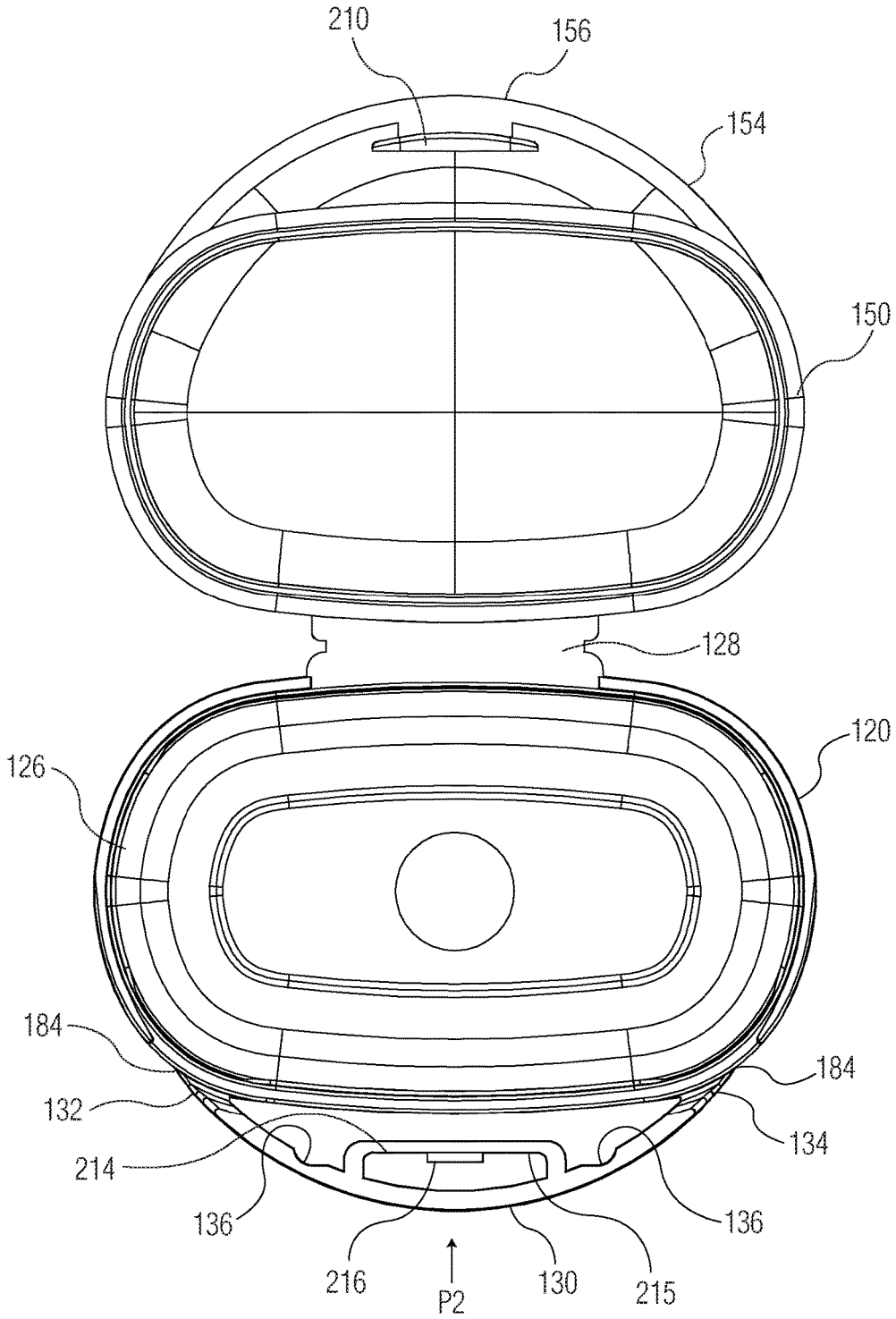
FIG. 16 is a top view of the container of FIG. 11, in an opened position.
Figure 17:
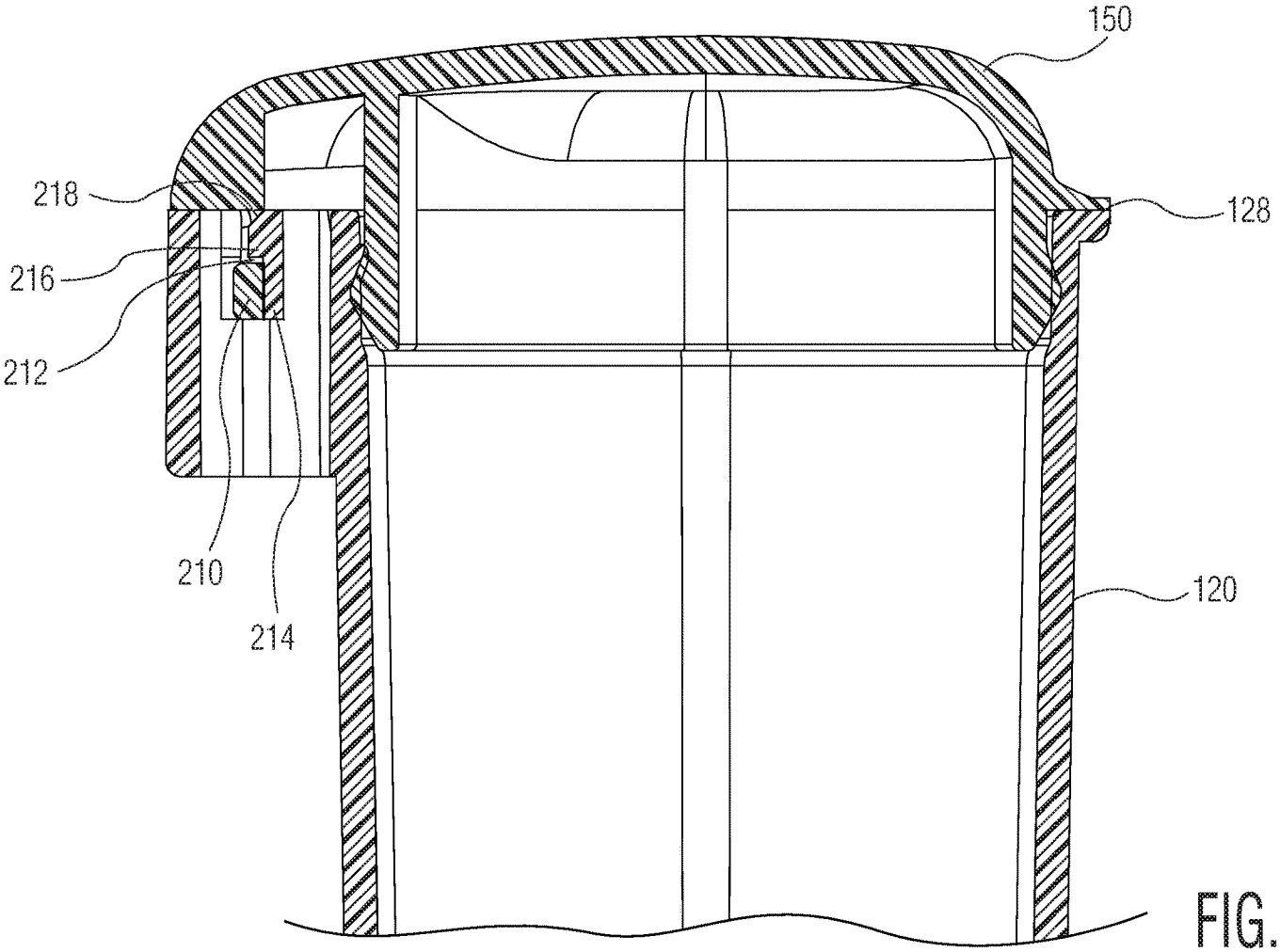
FIG. 17 is an enlarged detail of a cross section taken along line 17-17 of FIG. 11.
Figure 18:
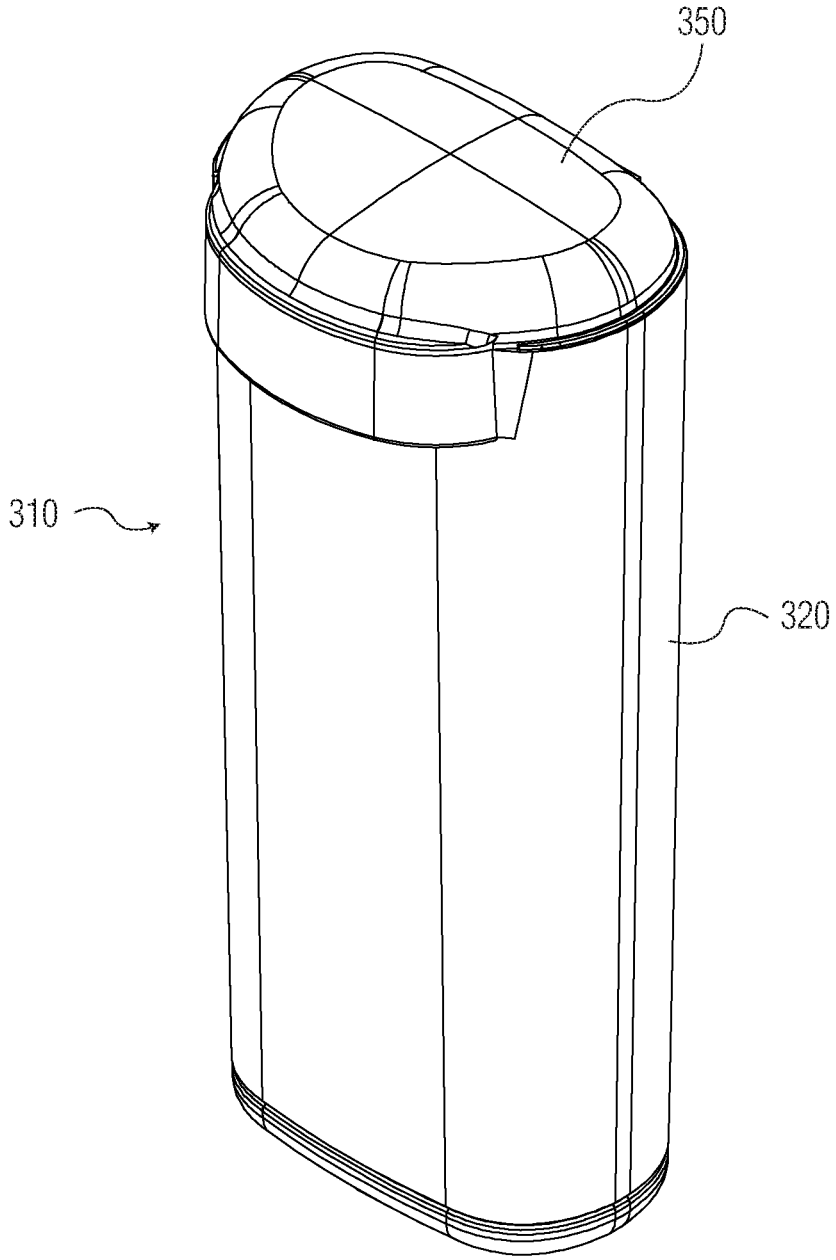
FIG. 18 is a front perspective view of a second alternative embodiment of a container according to the invention, in a closed position.
Figure 19:
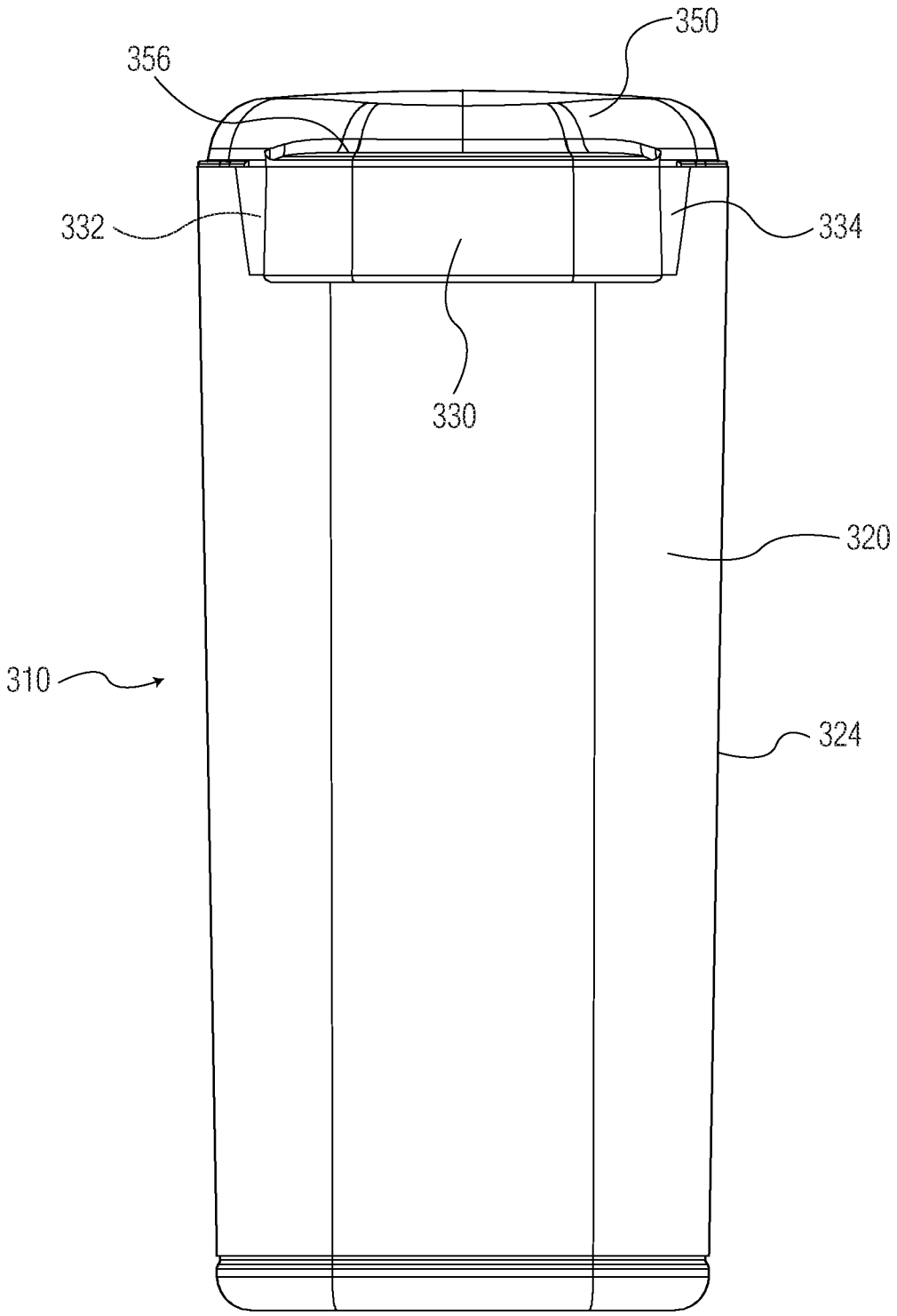
FIG. 19 is a front view of the container of FIG. 18.
Figure 20:
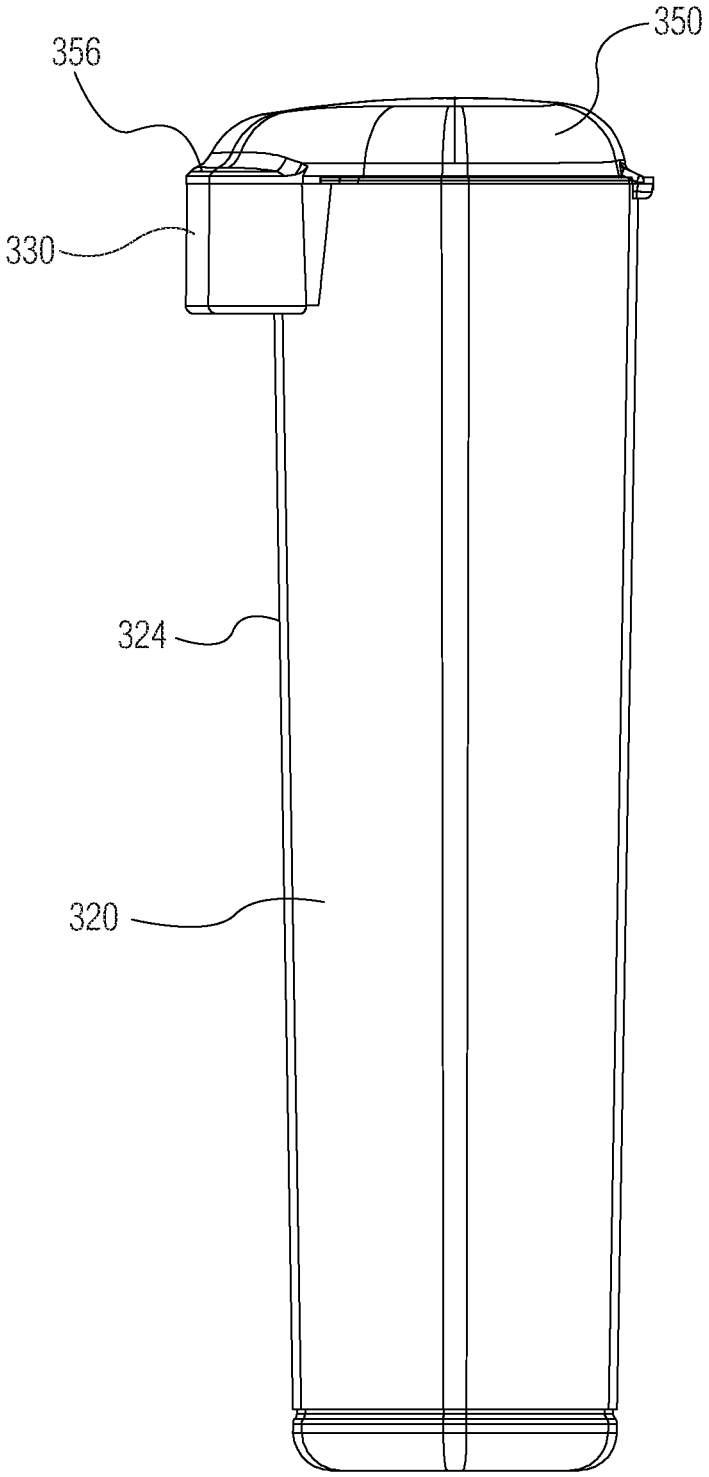
FIG. 20 is a side view of the container of FIG. 18.

The container 110 includes a body 120 and a cap 150. The body 120 includes a base wall 122 and a tubular side wall 124 that extends upward from the base wall 122 about an outer perimeter thereof. The base wall 122 and side wall 124 together define a container interior 112 for housing a plurality of products. In the illustrated embodiment, the base wall is of an oval shape and the side wall 124 has a similar oval cross section, but the container body 120 could take on other shapes as well. An opening 126 leading to the interior 112 is defined by an upper edge of the side wall 124. The cap 150 is configured to removably affix over the opening 126 to move the container 110 between an opened position in which the opening is exposed, as shown in FIGS. 14-16, and a closed position in which the cap 150 covers the opening 126, as shown in FIGS. 11 and 17. FIGS. 12 and 13 show the container 110 in a partially opened position to provide views of the child resistant closure, discussed below. The cap 150 may be pivotally attached to the container body 20 by a hinge 128, which allows the cap 150 to pivot between the opened position and the closed position.

The cap 150 includes a top wall 152 and an outer skirt 154 extending downwardly therefrom, about an outer perimeter thereof. In the illustrated embodiment, the top wall 152 and the skirt 154 are curved downward towards the container body 120, forming a substantially oval dome shape. When the container 110 is in the closed position, a lower portion of the skirt 154 meets with an upper portion of the side wall 124 to close the container 110. The hinge 128 extends between the skirt 154 and upper edge of the side wall 124 to pivotally join the cap 150 with the body 120. In the illustrated embodiment, the hinge 128 is of the living hinge type, i.e., formed integrally with the body 120 and cap 150, for example by co-molding or simply being formed as a continuation of the material of the body 120 and cap 150. This can be achieved, for example, by molding the body 150 and cap 120 together, such that they are joined by a section of material thin enough so as to permit folding, and in turn pivoting between the body 150 and cap 120. In other embodiments, the hinge 128 could be a separate mechanical element affixed to the body 120 and cap 150.

The cap 150 further includes a front tab 156. The tab 156 extends forward from a front portion of the cap 150, located opposite the hinge 128. In the illustrated embodiment, the tab 156 is simply an irregular extension along the front of the cap 150, and includes portions of both the top wall 152 and the skirt 154. The tab 156 serves to provide a user with access to a front, underside portion of the cap 150 in order to initiate pivoting outwardly in direction P1, to open the container 110.

A guard 130 extends forward from a front portion of the side wall 124, near the top thereof, at a location beneath the tab 156 when the container 110 is in the closed position, and opposite the hinge 128. As shown, the guard 130 is formed as a strip projecting from a front portion of the side wall 124. The guard 130 has first and second outer ends 132, 134 attached to the side wall, extends in a direction perpendicular to a central axis X of the side wall, and curves outwardly from the side wall 124 between the first and second outer ends 132, 134. When the container 110 is in the closed position, as shown in FIGS. 11 and 17, the outer surface of the guard 130 is substantially flush with the outer surface of the skirt portion of the tab 156. The guard 130 may extend slightly further out in the radial direction of the container 110 than the skirt portion of the tab 156. The guard 130 preferably has a small profile. For example, the outer-most surface of the guard 130 is preferably about 2 mm to about 4 mm, or less (e.g., about 1 mm), from an outer surface of the side wall 124 of the container body 120. More preferably, the outer-most surface of the guard 130 is about 3 mm to about 4 mm from the outer surface of the side wall 124 of the container body 120.

A catch 210 extends, e.g., perpendicularly, from the underside 158 of the tab 156. The catch 210 is preferably recessed slightly back from the front surface of the tab 156. The catch includes an aperture 212. A support frame 214 extends from the inner surface of the guard 130 in a direction towards the side wall 124 of the container body 120. The support frame 214 is preferably symmetrical and includes an outward facing surface 215 with a protrusion 216 extending therefrom in a direction away from the side wall 124 of the container body 120. The protrusion 216 is preferably substantially rectangular or trapezoidal in shape, but other shapes are contemplated as well, including, but not limited to, square, triangular, circular and spherical. In the embodiment shown, the protrusion 216 includes a slanted top surface 218.

When the container 110 is closed, as shown in FIG. 17, the catch 210 is disposed in the space between the support frame 214 and the inner surface of the guard 130. In this position, the protrusion 216 mates with the aperture 212 to secure the container 110 in a closed position. The container 110 cannot be opened by pivoting the cap 150 in direction P1 while the protrusion 216 mates with the aperture 212. Thus, the guard 130 in combination with the catch 210 and support frame 214 may serve as a safety mechanism, for example as part of a child resistant closure mechanism that moves between an engaged position and a disengaged position, to impede opening of the container 110 by undesired individuals, such as children, when in the engaged position.

In order to open the container 110, the child resistant closure is moved from the engaged position, shown, e.g., in FIGS. 11 and 17, to the disengaged position, shown, e.g., in FIGS. 12 and 14. To accomplish this, guard 130 is first depressed in direction P2, causing it to deform inwardly, thus moving the support frame 214 and also the protrusion 216 slightly towards the side wall 124 of the container body 120. This causes the protrusion 216 to disengage from the aperture 212 in the catch 210, which enables the cap 150 to be pivoted in direction P1. This further provides a user with access to the underside 158 of tab 156, e.g., to pivot the cap 150 in direction P1. The slanted top surface 218 of the protrusion 216 helps facilitate transitioning between the closure mechanism's engagement position and disengagement position, and vice versa.

The guard 130 may include axially extending channels 136 formed on the inner surface thereof, facing the side wall 124. The channels 136 can serve as bending points of the guard 130 to facilitate deformation in direction P2. Notches 182, 184 may also be formed between the guard 130 and the side wall 124 to which the guard 130 is attached, adjacent to the first and second outer ends 132, 134 of the guard and extending downward from the upper edge thereof. Notches 182, 184 further facilitate bending the guard 130 to cause deformation in direction P2. Once the guard 130 is depressed sufficiently in direction P2 so as to expose the underside 158 of tab 156, the user can force the tab 156 and in turn the cap 150 to pivot in direction P1, by applying force to the underside 158 of tab 156 in direction P1. The guard 130 is biased to the engaged position shown in FIGS. 11 and 17, such that it returns to that shape when the pressure in direction P2 is released.

The embodiment of the container shown in FIGS. 11-17 nicely balances the need for a guard 130 with a small profile (e.g., having an outer-most surface that is about 2 mm to 4 mm, or less, from the outer surface of the side wall 124 of the container body 120), which substantially retains the child resistant closure functionality of a larger profiled guard.

Referring now to FIGS. 18-22, there is shown a second alternative embodiment of a container 310 according to the present invention. The container 310 may include some, substantially all, or all features of the container 10 of FIGS. 1-10 and/or the container 110 of FIGS. 11-17, described above, such as the basic design, shape, container structure, seal structure, moisture-tightness of seal, etc. Preferably, the container 310 is essentially identical to alternative container 110, except for the following three features.

First, the container 310 includes no notches at the upper edge of the first and second outer ends 332, 334 of the guard 330. Omission of notches may be preferred to the extent that they may undesirably provide an access point for prying open the cap (e.g., with fingers or teeth), thus circumventing the child resistant closure.

Figure 21:
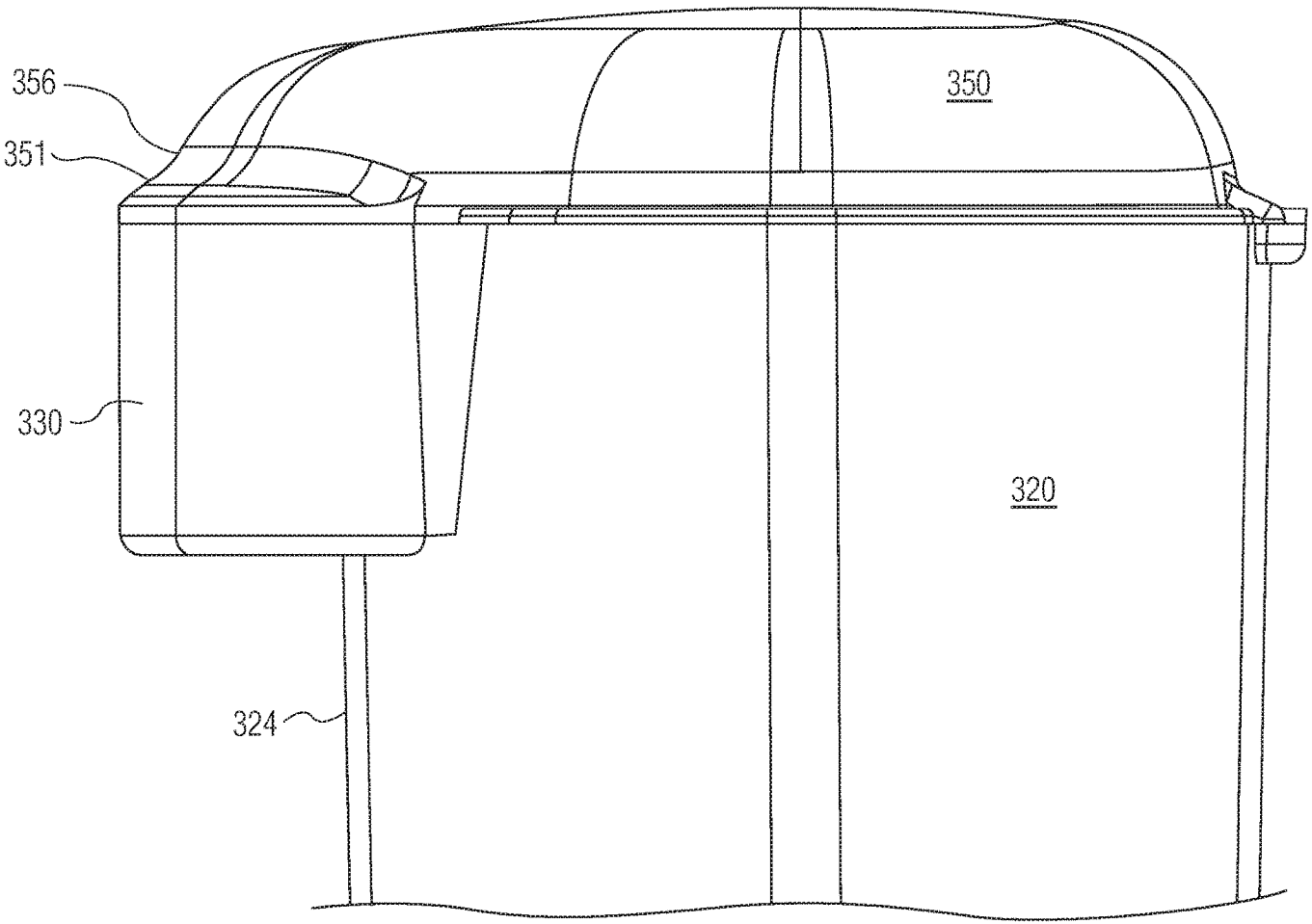
FIG. 21 is an enlarged side view of the container of FIG. 18.

Second, as best shown in FIG. 21, the tab 356 of the cap 350 includes a bill 351 having a more gradual slope than the cap 150 of container 110.

Figure 22:
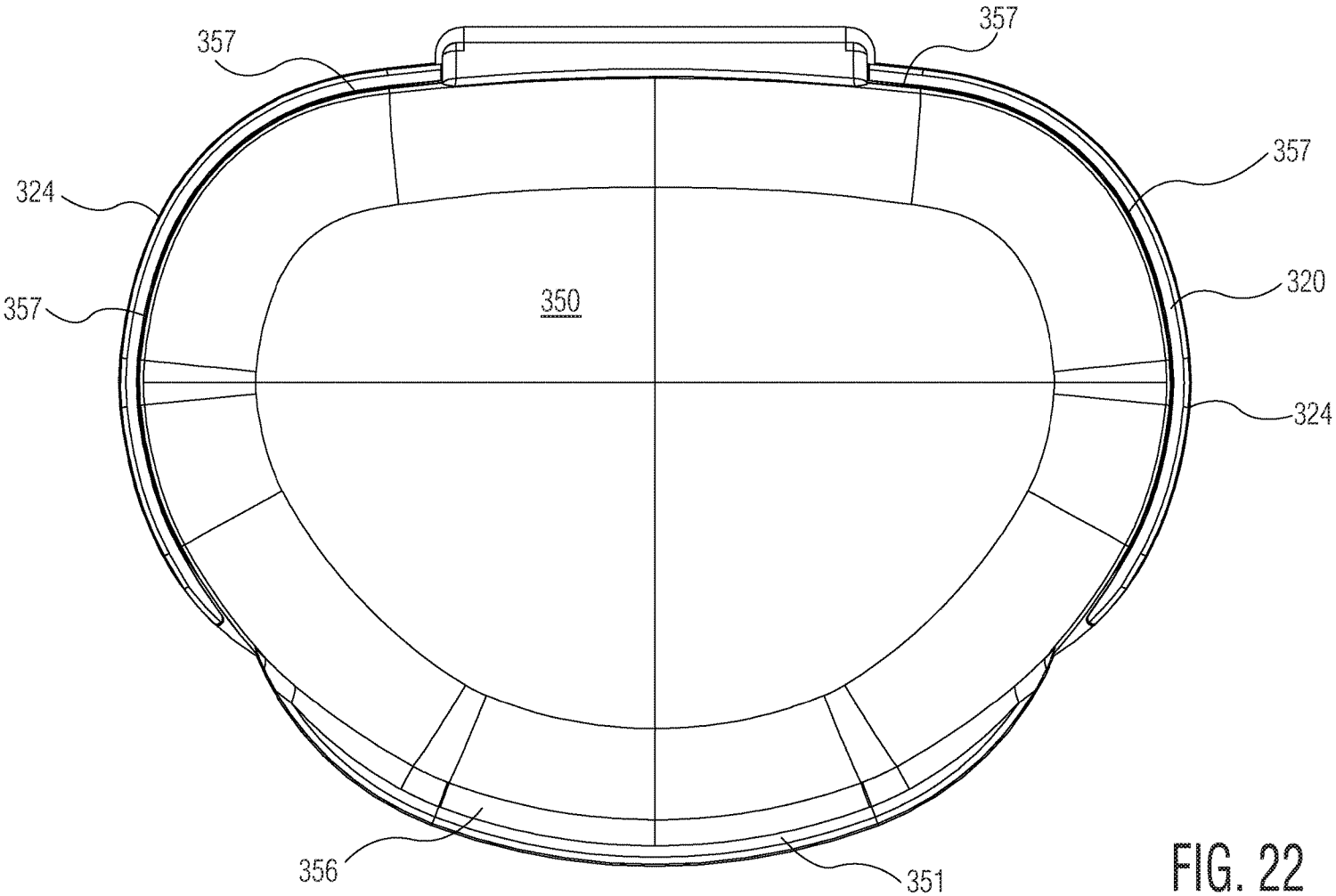
FIG. 22 is a top view of the container of FIG. 18.

Third, as best shown in FIG. 22 (but optionally applicable to any embodiment), the cap 350 preferably has an outer perimeter 357, at least a portion of which is slightly smaller than, i.e., disposed radially inward with respect to, the side wall 324 of the container body 320. This preferred feature would preferably render the entire under side of the cap 350 inaccessible to prevent circumvention of the child release mechanism to pry open the container 310. Optionally, the perimeter of the cap 350 is disposed radially inward by at least 1 mm with respect to the side wall 324 of the container body 320 along the perimeter of the side wall 324, optionally with the exception of the hinge and the guard.

Optionally, in any embodiment, the container is constructed of one or more polymeric materials, optionally an injection moldable plastic such as polypropylene, polyethylene or cyclic olefin copolymer, for example. Optionally, in any embodiment, the guard is constructed of a thermoplastic elastomer material. In any embodiment, the guard is resilient and configured to return to its original shape after numerous cycles of being depressed radially to open the container. Optionally, in any embodiment, the outward facing surface of the guard is substantially rounded.

Optionally, in any embodiment, the cap may be moved from the opened position to the closed position by applying downward pressure onto the top of the cap, without the need to engage the guard. For example, one may close the cap on the container without depressing and/or releasing the guard, since the guard optionally does not function to hold the cap closed.

Optionally, in any embodiment, the child resistant closure is disengaged and the cap opened all with a single hand.

Optionally, in any embodiment, the container is made from a single-shot of injection molded polymeric material.

Optionally, in any embodiment, the container body is elongate and tubular. Optionally, in any embodiment, the container body has an internal cross section and/or an external cross section that is elliptical.

Optionally, embodiments of containers used according to aspects of the present invention can be molded according to techniques disclosed in U.S. Pat. No. Re 37,676 (a reissue of U.S. Pat. No. 5,723,085), U.S. Pat. Nos. 4,812,116, and 4,783,056, all of which are incorporated herein by reference.

While the preferred embodiments of the invention have been described in detail above, the invention is not limited to the specific embodiments described, which should be considered as merely exemplary.

What is claimed is:

1. A method for opening a container, the method comprising the steps of:

a. providing a container comprising:

i. a body having a base and a side wall extending up from the base leading to an opening that permits access to an interior of the body;

ii. a cap pivotally secured to the body by a hinge, the cap being movable about the hinge with respect to the body to move the cap between a closed position in which the cap covers the opening to an opened position in which the opening is exposed; and iii. a child resistant closure configured to impede moving the cap from the closed position to the opened position when the child resistant closure is in an engaged position, the child resistant closure comprising:

a resilient guard extending radially outward from the body, adjacent to the opening, wherein the guard in a fully extended position has an outer-most surface that is 4 mm or less from an outer surface of the side wall of the body; and a front tab of the cap located opposite the hinge, the front tab having an underside configured for receiving upward pressure to pivot the cap from the closed position to the opened position, wherein the engaged position of the child resistant closure comprises the guard being in its fully extended position with the cap in the closed position, such that the guard blocks access to the underside of the front tab;

b. applying inward radial pressure on the guard sufficient to inwardly deflect the guard so as to displace at least a portion of the outer-most surface of the guard radially inward to a disengaged position of the child resistant closure, wherein at least a portion of the underside of the front tab is exposed for manual application of upward pressure; and c. after step (b), applying upward pressure to the underside of the front tab to pivot the cap from the closed position to the opened position;

wherein upon release of the inward radial pressure on the guard, the guard automatically returns to its fully extended position.

2. The method of claim 1, further comprising the following step:

d. after step (c), releasing the inward radial pressure on the guard, whereupon the guard automatically returns to its fully extended position.

3. The method of claim 1, wherein the guard is substantially flush with or extends radially outward relative to the front tab when the child resistant closure is in the engaged position.

4. The method of claim 1, wherein the cap comprises a top wall and a skirt extending downward from the top wall, about an outer perimeter of the top wall.

5. The method of claim 1, wherein the guard consists of a single strip of polymeric material.

6. The method of claim 5, wherein the strip has an outward facing surface that is substantially rounded.

7. The method of claim 1, wherein the guard in its fully extended position has an outer-most surface that is from 2 mm to 4 mm from the outer surface of the sidewall of the body.

8. The method of claim 1, wherein a seal is formed between the body and the cap when the container is in the closed position, wherein the seal is not dependent upon the child resistant closure being in the engaged position or the disengaged position.

9. The method of claim 8, wherein the seal is a moisture tight seal.

10. The method of claim 1, wherein the container is made from a single-shot of injection molded polymeric material.

11. The method of claim 1, the guard comprising first and second inner ends that are respective locations of attachment of an inside of the guard to the outer surface of the side wall of the body, the guard having a width ($W_G$) measured in a straight line from the first inner end to the second inner end, the guard having a depth ($D_G$) measured in a straight line from the outer surface of the side wall to the outer-most surface of the guard, wherein a ratio of $W_G$:$D_G$ is at least 6:1.

12. The method of claim 1, wherein the container is held by a single hand and wherein at least steps (b) and (c) are performed using the single hand.

13. The method of claim 1, wherein the guard consists of a single strip of polymeric material, the strip having an outward facing surface that is substantially rounded, wherein the guard includes axially extending channels formed on an inner surface of the guard facing the side wall of the body, the channels serving as bending points of the guard to facilitate inward deflection of the guard in step (b).

14. A method for opening a container, the method comprising the steps of:

a. providing a container comprising:

i. a body having a base and a side wall extending up from the base leading to an opening that permits access to an interior of the body;

ii. a cap pivotally secured to the body by a hinge, the cap being movable about the hinge with respect to the body to move the cap between a closed position in which the cap covers the opening to an opened position in which the opening is exposed; and iii. a child resistant closure configured to impede moving the cap from the closed position to the opened position when the child resistant closure is in an engaged position, the child resistant closure comprising:

a resilient guard extending radially outward from the body, adjacent to the opening, wherein the guard in a fully extended position has an outer-most surface that is radially spaced from an outer surface of the side wall of the body, the guard comprising first and second inner ends that are respective locations of attachment of an inside of the guard to the outer surface of the side wall of the body, the guard having a width ($W_G$) measured in a straight line from the first inner end to the second inner end, the guard having a depth ($D_G$) measured in a straight line from the outer surface of the side wall to the outer-most surface of the guard, wherein a ratio of $W_G$:$D_G$ is at least 6:1; and a front tab of the cap located opposite the hinge, the front tab having an underside configured for receiving upward pressure to pivot the cap from the closed position to the opened position, wherein the engaged position of the child resistant closure comprises the guard being in its fully extended position with the cap in the closed position, such that the guard blocks access to the underside of the front tab;

b. applying inward radial pressure on the guard sufficient to inwardly deflect the guard so as to displace at least a portion of the outer-most surface of the guard radially inward to a disengaged position of the child resistant closure, wherein at least a portion of the underside of the front tab is exposed for manual application of upward pressure; and c. after step (b), applying upward pressure to the underside of the front tab to pivot the cap from the closed position to the opened position;

wherein upon release of the inward radial pressure on the guard, the guard automatically returns to its fully extended position.

15. The method of claim 14 further comprising the following step:

d. after step (c), releasing the inward radial pressure on the guard, whereupon the guard automatically returns to its fully extended position.

16. The method of claim 14, wherein the outer-most surface of the guard in the fully extended position is 4 mm or less from the outer surface of the side wall of the body.

17. The method of claim 14, wherein the guard is substantially flush with or extends radially outward relative to the front tab when the child resistant closure is in the engaged position.

18. The method of claim 14 wherein the guard consists of a single strip of polymeric material and wherein the strip has an outward facing surface that is substantially rounded.

19. The method of claim 18, wherein the guard includes axially extending channels formed on an inner surface of the guard facing the side wall of the body, the channels serving as bending points of the guard to facilitate inward deflection of the guard in step (b).

20. The method of claim 14, wherein the container is made from a single-shot of injection molded polymeric material.

21. A method for opening a container, the method comprising the steps of:

a. providing a container made from a single-shot of injection molded polymeric material, the container comprising:

i. a body having a base and a side wall extending up from the base leading to an opening that permits access to an interior of the body;

ii. a cap pivotally secured to the body by a hinge, the cap being movable about the hinge with respect to the body to move the cap between a closed position in which the cap covers the opening to an opened position in which the opening is exposed; and iii. a child resistant closure configured to impede moving the cap from the closed position to the opened position when the child resistant closure is in an engaged position, the child resistant closure comprising:

a resilient guard which consists of a single strip of polymeric material extending radially outward from the body, adjacent to the opening, wherein the guard in a fully extended position has an outer-most surface that is 4 mm or less from an outer surface of the side wall of the body, the guard comprising first and second inner ends that are respective locations of attachment of an inside of the guard to the outer surface of the side wall of the body, the guard having a width ($W_G$) measured in a straight line from the first inner end to the second inner end, the guard having a depth ($D_G$) measured in a straight line from the outer surface of the side wall to the outer-most surface of the guard, wherein a ratio of $W_G$:$D_G$ is at least 6:1; and a front tab of the cap located opposite the hinge, the front tab having an underside configured for receiving upward pressure to pivot the cap from the closed position to the opened position, wherein the engaged position of the child resistant closure comprises the guard being in its fully extended position with the cap in the closed position, such that the guard blocks access to the underside of the front tab, wherein the guard is substantially flush with or extends radially outward relative to the front tab when the child resistant closure is in the engaged position;

b. applying inward radial pressure on the guard sufficient to inwardly deflect the guard so as to displace at least a portion of the outer-most surface of the guard radially inward to a disengaged position of the child resistant closure, wherein at least a portion of the underside of the front tab is exposed for manual application of upward pressure;

c. after step (b), applying upward pressure to the underside of the front tab to pivot the cap from the closed position to the opened position; and d. after step (c), releasing the inward radial pressure on the guard, whereupon the guard automatically returns to its fully extended position.

22. The method of claim 21, wherein the strip has an outward facing surface that is substantially rounded and wherein the guard includes axially extending channels formed on an inner surface of the guard facing the side wall of the body, the channels serving as bending points of the guard to facilitate inward deflection of the guard in step (b).

* * * * *